US009079427B2

(12) United States Patent
Duffield

(10) Patent No.: US 9,079,427 B2
(45) Date of Patent: Jul. 14, 2015

(54) STAGGERED ULTRA-VIOLET CURING SYSTEMS, STRUCTURES AND PROCESSES FOR INKJET PRINTING

(75) Inventor: John Peter Duffield, Meredith, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 247 days.

(21) Appl. No.: 13/459,719

(22) Filed: Apr. 30, 2012

(65) Prior Publication Data

US 2013/0286060 A1 Oct. 31, 2013

(51) Int. Cl.
*B41J 2/01* (2006.01)
*B41J 11/00* (2006.01)
*B41J 29/38* (2006.01)

(52) U.S. Cl.
CPC ..... *B41J 11/002* (2013.01); *B41J 29/38* (2013.01)

(58) Field of Classification Search
CPC ..... B41J 11/002; B41J 29/38; B41J 2/01; C09D 11/10
USPC ..... 347/102, 5; 427/493
See application file for complete search history.

(56) References Cited

U.S. PATENT DOCUMENTS 5,978,071 A * 11/1999 Miyajima et al. ..... 355/53
6,457,823 B1 10/2002 Cleary et al.
6,485,301 B1 * 11/2002 Gemunder et al. ..... 433/29
6,683,421 B1 1/2004 Kennedy et al.
2005/0018026 A1 1/2005 Nerad et al.
2006/0066703 A1 3/2006 Kadomatsu et al.
2006/0233501 A1 10/2006 Sampson
2010/0201771 A1 8/2010 Mitsuzawa
2011/0069128 A1 * 3/2011 Onishi ..... 347/102
2011/0096132 A1 * 4/2011 Kobayashi et al. ..... 347/102
2011/0128319 A1 * 6/2011 Mitsuzawa ..... 347/16

FOREIGN PATENT DOCUMENTS

EP 1599340 A1 11/2005
GB 2399162 A 9/2004

* cited by examiner

*Primary Examiner* — Sarah Al Hashimi
(74) *Attorney, Agent, or Firm* — Michael A. Glenn; Perkins Coie LLP

(57) ABSTRACT

Enhanced printing systems, structures, and processes provide enhanced pinning of light sensitive inks before curing, such as to avoid artifacts, e.g. between colors, and/or between regions of different color densities. One or more pinning lamps are controlled or otherwise configured to deliver pinning energy over an interval, e.g. over a period of time or over a percentage of completion, to a pinning threshold level, which may be stored and/or determined. In some exemplary embodiments, the pinning energy is increased linearly over an interval. Other exemplary embodiments provide a stepped or staggered increase in applied pinning energy. An additional level of pinning may preferably be provided after pinning and before curing, at an energy level over the first pinning threshold, and below the curing threshold. The enhanced printing systems, structures, and processes reduce and/or eliminate moderate or large transitions of UV light energy, which may otherwise cause image artifacts.

15 Claims, 18 Drawing Sheets

60a
62
64
Controller
Processor
66
Storage
68
70
User Interface
USR
72
Substrate Movement Mechanism
74
Substrate Rollers, Platen, etc
76
Carriage Movement Mechanism
78
Printer Carriage
82a
82k
Ink
Ink Delivery System
80
Print Heads
84
Pinning Lamp Power Mechanism
86
Pinning Lamps
44
Pinning Shutter Control Mechanism
88
Pinning Shutter(s)
46
Curing Lamp Power Mechanism
94
Curing Lamp(s)
96

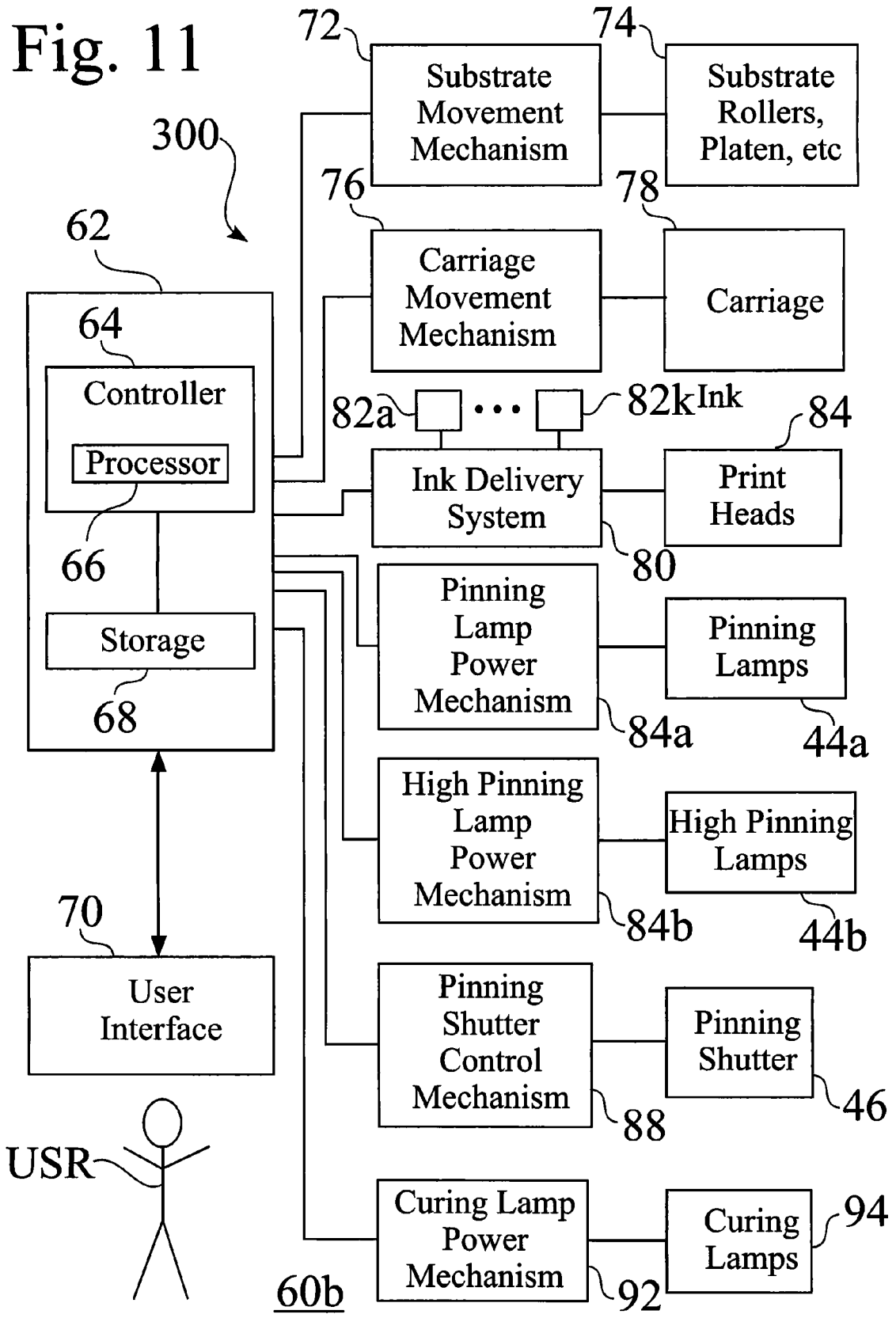
Fig. 11
300
62
64
Controller
Processor
66
Storage
68
70
User Interface
USR
60b
72
Substrate Movement Mechanism
74
Substrate Rollers, Platen, etc
76
Carriage Movement Mechanism
78
Carriage
82a
82k
Ink
84
Ink Delivery System
Print Heads
80
Pinning Lamp Power Mechanism
Pinning Lamps
84a
44a
High Pinning Lamp Power Mechanism
High Pinning Lamps
84b
44b
Pinning Shutter Control Mechanism
Pinning Shutter
88
46
Curing Lamp Power Mechanism
Curing Lamps
92
94

STAGGERED ULTRA-VIOLET CURING SYSTEMS, STRUCTURES AND PROCESSES FOR INKJET PRINTING

FIELD OF THE INVENTION

The present invention relates generally to the field of ultra-violet (UV) curing of inkjet printed ink. More particularly, the present invention relates to systems, structures, and processes for pinning and polymerizing ink, using different levels of UV dosage.

BACKGROUND OF THE INVENTION

Conventional UV curing of inkjet printed ink is done in a number of ways, such as with one or two high powered mercury arc lamps, that fully polymerize the ink in one or more exposures. High-powered UV LED lamps may also be employed to replace the mercury arc lamps to work in a similar fashion. These LED or Mercury lamps can be located close to or remote from the print area.

Another method of curing is to pin the printed ink with a low power UV lamp, either mercury arc or LED, close to the print area. Then, as a post process, the pinned ink is exposed to a high power UV source (mercury or LED) to fully cure the ink.

In some applications where the ink is laid down, then exposed to low powered pinning UV lamps first, and then exposed to high powered curing UV lamps, there are a number of circumstances where the transition between low and high power creates undesirable artifacts in the cured ink.

Inkjet printing is extremely precise, and dots are laid down accurately, to within less than one thousandth of an inch. Unfortunately, the UV light used to cure the ink cannot easily be controlled with such precision. Therefore, there will always be light spillage into areas of the print that are not desirable. This light spillage can cause a gloss differential in the print, if the ink is not substantially cured when the variable level of UV hits it.

It would be advantageous to provide a structure, system and/or process that provide sufficient pinning of light sensitive ink before final curing, while reducing or eliminating image artifacts. The development of such a system, structure, and/or process would provide a significant advance.

It would also be advantageous to provide a structure, system and/or process that provides sufficient pinning of light sensitive ink before final curing, which can be controllably altered for a wide variety of inks and printing conditions. The development of such a system, structure, and/or process would provide a further significant advance.

SUMMARY OF THE INVENTION

Enhanced printing systems, structures, and processes provide enhanced pinning of light sensitive inks before curing, such as to avoid artifacts, e.g. between colors, and/or between regions of different color densities. One or more pinning lamps are provided, which are controlled or otherwise configured to deliver pinning energy over an interval, e.g. over a period of time or over a percentage of completion, to a pinning threshold level, wherein the threshold level may be stored and/or determined. In some exemplary embodiments, the pinning energy is increased linearly over an interval. Other exemplary embodiments provide a stepped or staggered increase in applied pinning energy. In some alternate embodiments, a further level of pinning, referred to as high pinning, may preferably be provided, such as after pinning and before curing, at an energy level over the first pinning threshold level, and below the curing threshold level. The enhanced printing systems, structures, and processes reduce and/or eliminate moderate or large transitions of UV light energy, such as by generating a linear increase in power, or a multi-stepped increase in power that has small transitions, below one or more determined thresholds that may otherwise cause image artifacts.

BRIEF DESCRIPTION OF THE DRAWINGS

FIG. 11 is an exemplary block diagram of an alternate enhanced printing system that may be configured to provide high pinning;

DETAILED DESCRIPTION OF PREFERRED EMBODIMENTS

Figure 1:
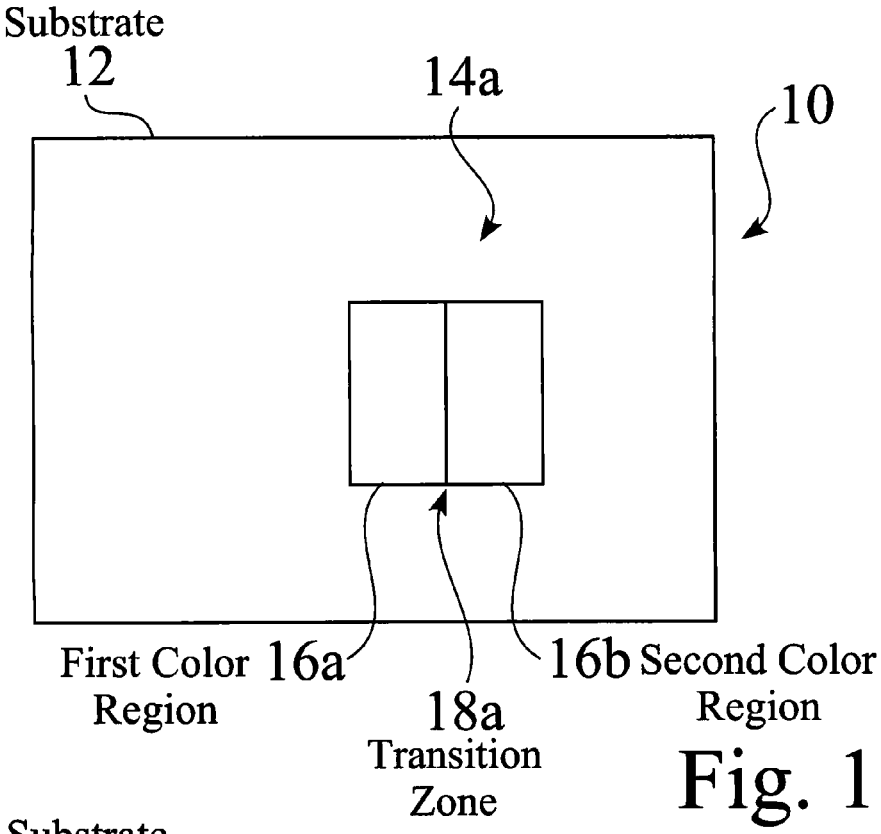
FIG. 1 is a schematic view of ink applied to a substrate, wherein the ink transitions between a first color region and a second color region.

FIG. 1 is a simplified schematic view 10 of delivered ink 82, e.g. 82*a*, 82*k* (FIG. 4), that is applied 206 (FIG. 6) to a substrate 12 to create an graphic object or image 14, e.g. 14*a*, wherein the exemplary ink 82 defines a first color region 16*a* and a second color region 16*b*, and may have a transition zone 18, e.g. 18*a*, defined there between.

Figure 2:
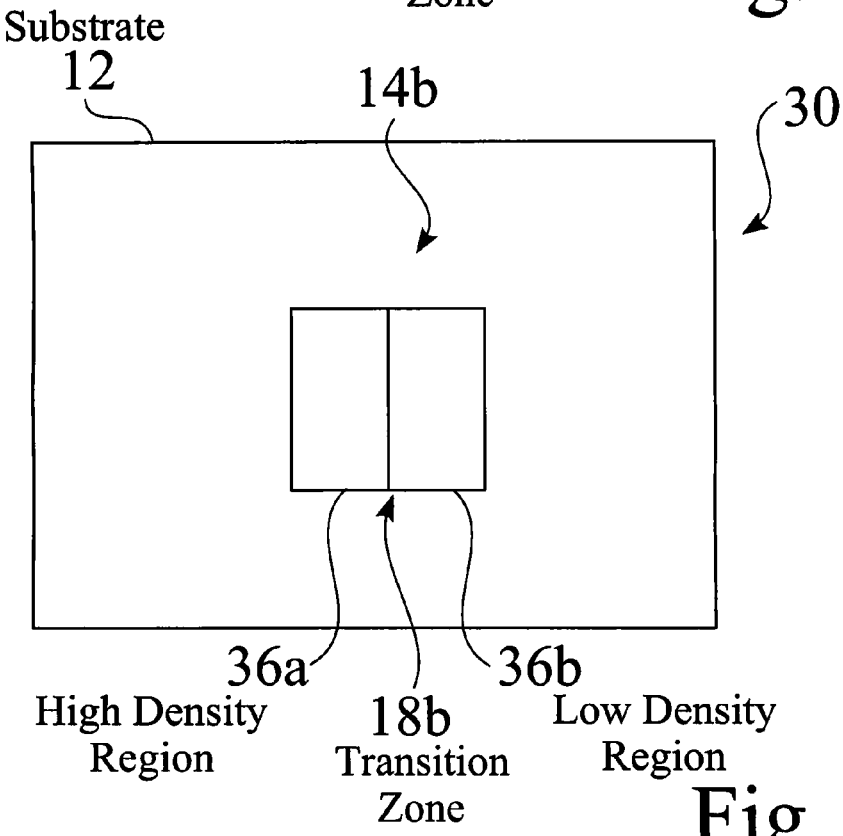
FIG. 2 is a schematic view of ink applied to a substrate, wherein the ink transitions between a high density region and a low density region.

FIG. 2 is a simplified schematic view 30 of delivered ink 82, e.g. 82*a*, that is applied 206 to a substrate 12 to create an graphic object or image 14*b*, wherein the exemplary ink 82 defines a high density region 36*a* and a low density region 36*b*, and may have a transition zone 18*b* defined there between.

Figure 3:
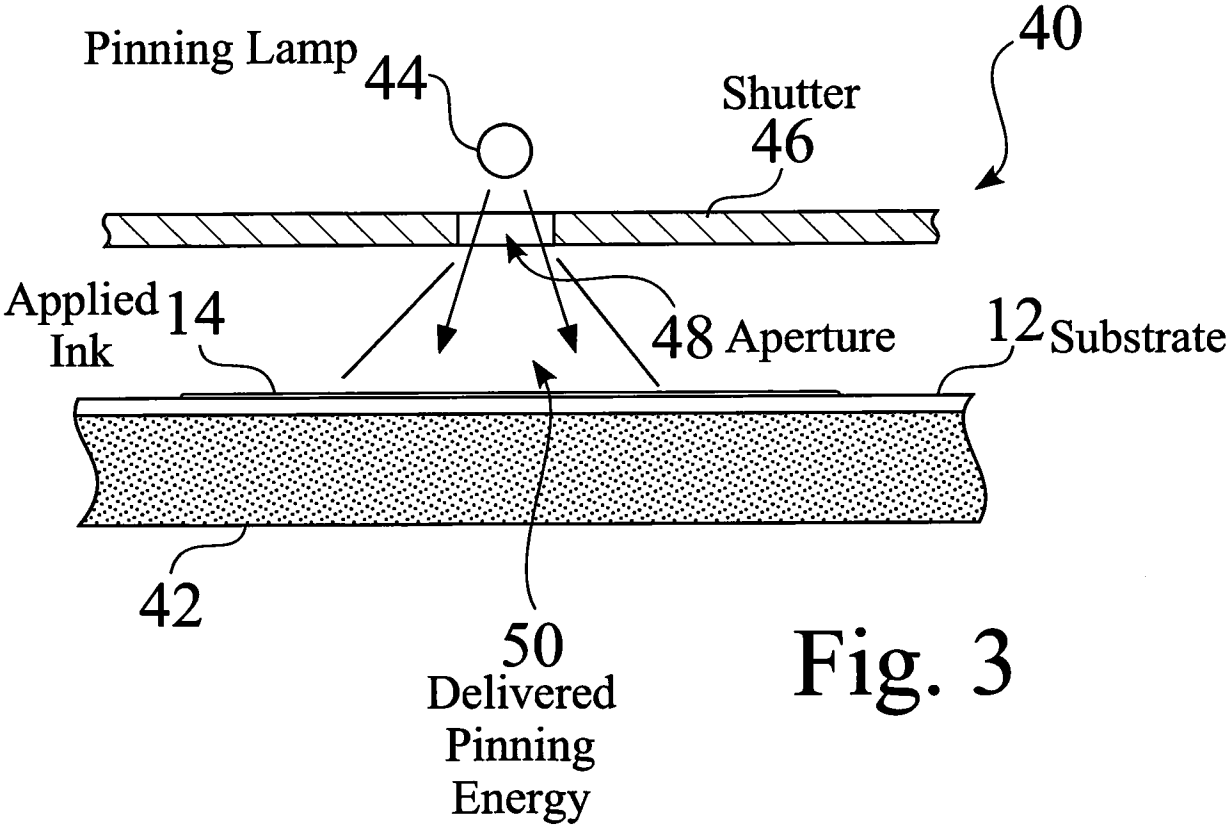
FIG. 3 is a schematic partial cutaway view of an exemplary structure for applying pinning energy to a substrate having light sensitive ink jet ink applied thereon, wherein a shutter is located between a pinning lamp and the substrate.

FIG. 3 is a schematic partial cutaway view of an exemplary enhanced structure 40 for applying pinning energy 50 to a substrate 12 having light sensitive ink jet ink 82 applied 206 (FIG. 6) thereon, wherein a shutter 46 is located between a pinning lamp 44 and the substrate 12. The exemplary substrate 12 seen in FIG. 3 is supported 42, such as by a platen or a drum.

Figure 4:
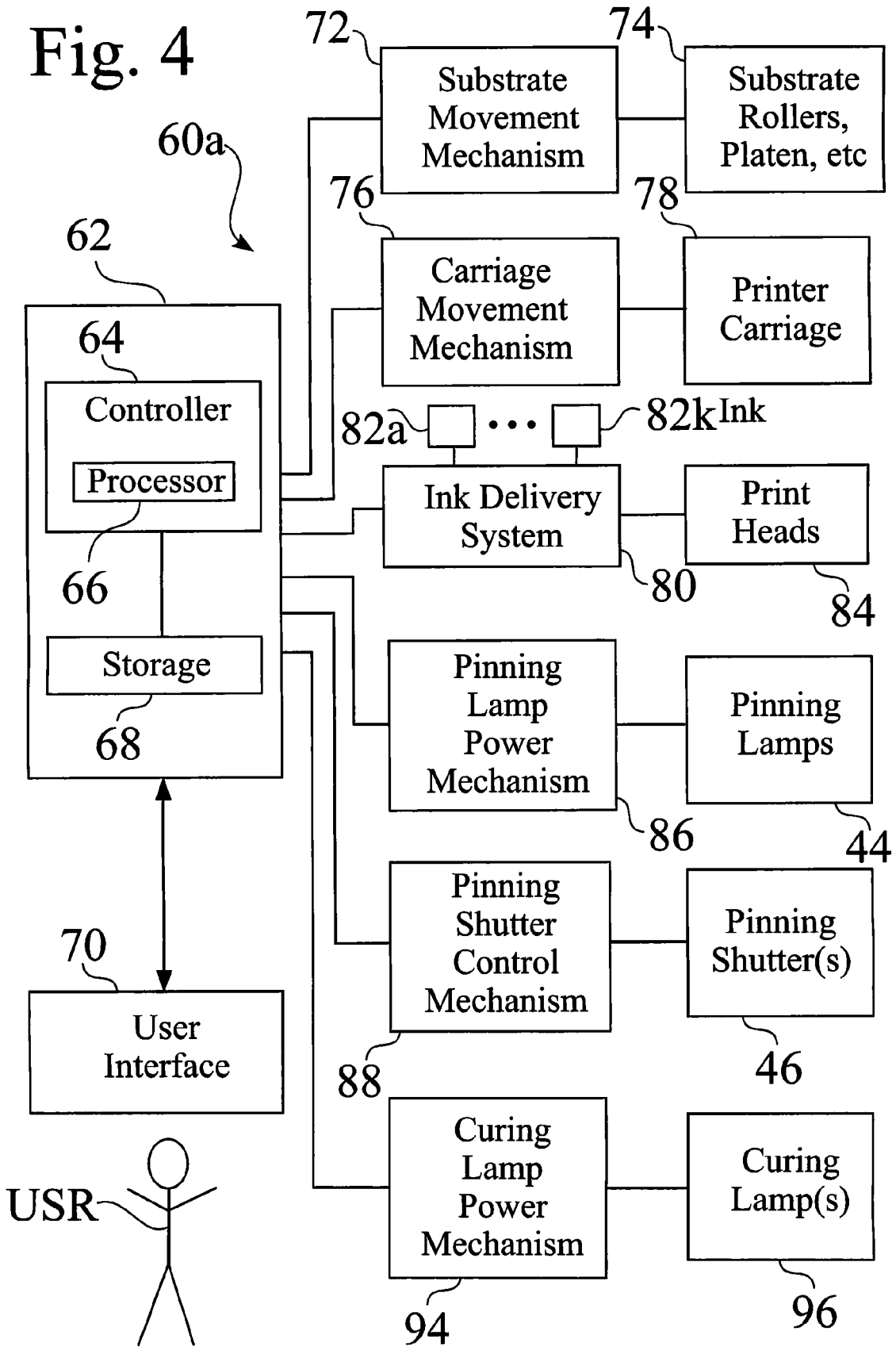
FIG. 4 is an exemplary block diagram of an enhanced printing system having one or more pinning lamps, a mechanism for altering the delivered energy of the pinning lamps, e.g. one or more pinning shutters, and one or more processors.

FIG. 4 is an exemplary block diagram of an enhanced printing system 60, e.g. 60*a*, comprising one or more pinning lamps 44, one or more pinning shutters 46, and one or more processors 66. The exemplary base module 62 seen in FIG. 4 comprises a controller 64 having one or more processors 66 associated therewith, and at least one storage 68. The pinning lamps 44 typically comprise any of mercury arc lamps, UV light emitting diodes (LEDs), or any combination thereof. In some exemplary embodiments, the pinning lamps 44 may have a characteristic wavelength anywhere in the UV region or even scattered, i.e. mercury arc if not LED. For example, the characteristic wavelength of UV LED pinning lamps 44 typically vary from 365 nm to 415 nm (UVA to UVV light), while the characteristic UV power output intensity range may vary from about 1 watt per square inch up to 10 watts per square inch.

The controller 64 seen in FIG. 4 may preferably provide control for one or more associated systems, such as for but not limited to any of:

- a substrate movement mechanism 72 and associated hardware 74, e.g. rollers, platen, input and/or output, etc.;
- a carriage movement mechanism 76 associated with a printer carriage 78;
- an ink delivery system 80 for delivering ink 82, e.g. 82*a*-82*k*, to one or more print heads 84;
- a pinning lamp power mechanism 86 associated with one or more pinning lamps 44;
- a pinning shutter control mechanism 88 associated with one or more pinning shutters 44; and/or
- a curing lamp power mechanism 94 associated with one or more curing lamps 96.

Figure 5:
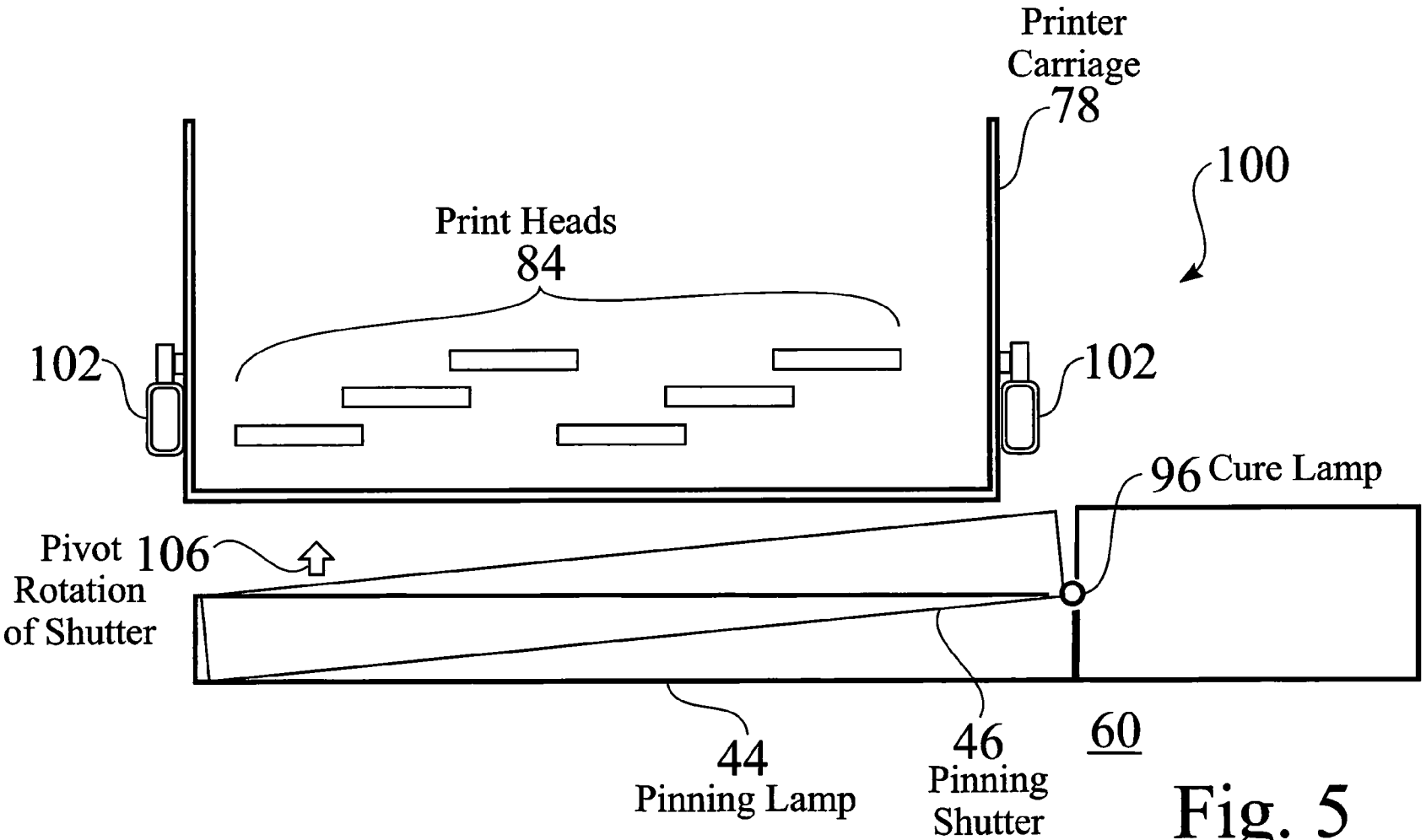
FIG. 5 is a schematic view of an exemplary enhanced printing system having one or more pinning lamps, one or more pinning shutters, a cure lamp, and one or more print heads associated with a print carriage.

FIG. 5 is a schematic view 100 of an exemplary enhanced printing system 60, e.g. 60*a*, comprising one or more pinning lamps 44, one or more pinning shutters 46, e.g. such as but not limited to a pivotable 106 shutter 46*b* (FIG. 18), a cure lamp 96, and one or more print heads 84 associated with a printer carriage 78. As seen in FIG. 5, the printer carriage 78 may be controllably movable with respect to one or more rails 102.

The exemplary enhanced printing system 60 seen in FIG. 5 may typically comprise at least one print head 84 for applying 206 light sensitive ink 82 to a substrate 12, a mechanism 74 for positioning any of the print head 84 or the substrate 14 in relation to each other, at least one pinning lamp 44, a mechanism 46, e.g. a shutter mechanism 46, for altering the delivered energy 50 of the at least one pinning lamp 44 to at least one portion of the substrate 12, at least one curing lamp 96, and at least one processor 66, wherein the at least one processor 66 is configured to control one or more of the print heads 84 to apply 206 the light sensitive ink 82 to the substrate 12, controllably increase 232 (FIG. 7-FIG. 10) an applied pinning energy 50 through the at least one pinning lamp 44, such as over a period 230 (FIG. 7-FIG. 10) of time 224 (FIG. 7-FIG. 10), or over a period or percentage of completion 582 (FIG. 25), to a determined threshold level 228 (FIG. 7-FIG. 10), and controllably operate the curing lamp 96 to cure the pinned applied ink 14.

Figure 6:
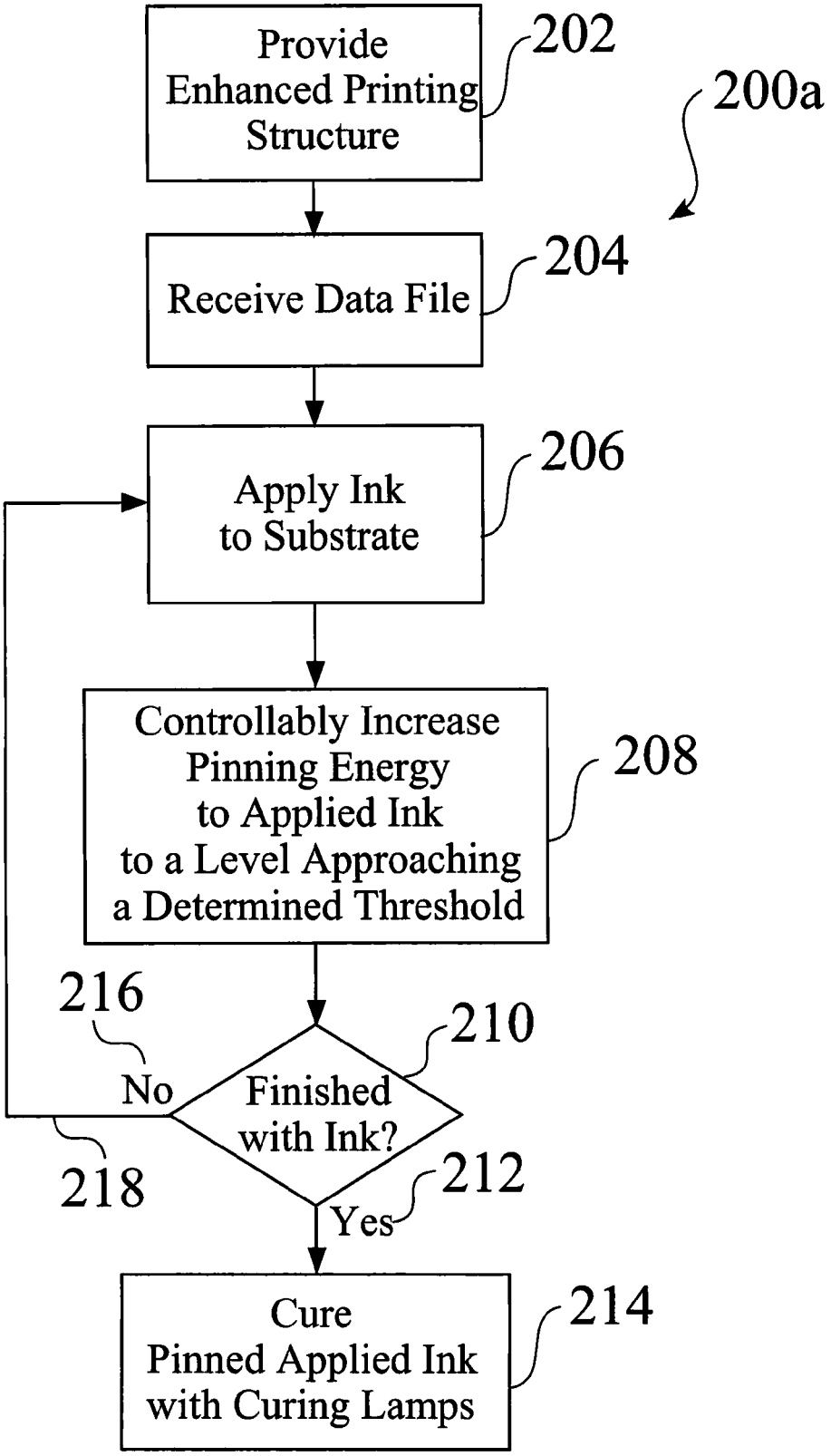
FIG. 6 is a flowchart of an exemplary process associated with an enhanced printing system, wherein one or more increasing levels of pinning are provided to ink on a substrate before final curing of the ink.

FIG. 6 is a flowchart of an exemplary process 200, e.g. 200*a*, associated with an enhanced printing system 60, wherein one or more increasing levels of pinning energy 50 are applied 208 to ink 82 on a substrate 12 before final curing 214 of the pinned ink 82. For example, through a provided 202 enhanced printing system 60, in response to a received 204 data file, ink 82 is controllably applied 206 to one or more portions of a substrate 12. At step 208, such as though the controller 64, pinning energy 50 is controllably increased to the applied ink 82, such as to a level at or approaching a determined pinning threshold 228. If more ink passes are required 210, 216, the process 200*a* may return 218, e.g. such as to add another ink color, e.g. a process color cyan C, magenta M, yellow Y, Black K, or a spot color, to build an image 14. If no further ink passes are required 210, 212, the process 200*a* typically proceeds to step 214, wherein the pinned applied ink is cured, through applied curing energy delivered from one or more curing lamps 96.

Figure 7:
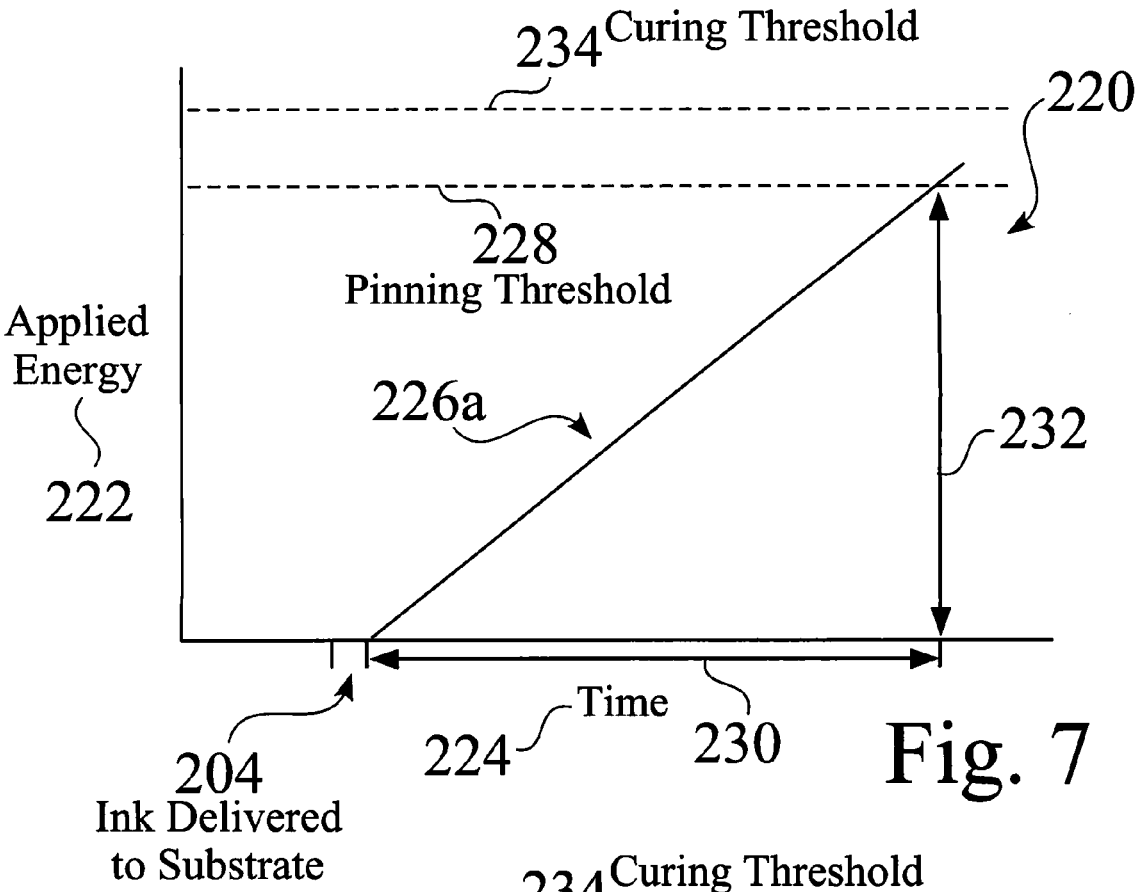
FIG. 7 is a chart that shows applied pinning energy as a function of time for an enhanced printing system, wherein the pinning energy is linearly increased.

FIG. 7 is a chart 220 that shows applied pinning energy 222 as a function of time 224 for an enhanced printing system 60, wherein the pinning energy 226, e.g. 226*a*, is linearly increased. For example, as seen in FIG. 7, after ink 82 is delivered 206, e.g. jetted 206, onto a substrate 12, pinning energy 226*a* is applied through one or more pinning lamps 44, such as to provide a linear increase in energy 222 over a period 230 of time 224, e.g. until the applied energy 50 reaches or extends beyond a pinning threshold 228. While some system embodiments 60 may directly control the power output of one or more pinning lamps 44, other system embodiments 60 may further comprise one or more pinning shutters 46 and associated controls 88, which may be operated in conjunction with the pinning lamps 44 to controllably increase the delivered pinning energy 222 over a period 230 of time 224.

Figure 8:
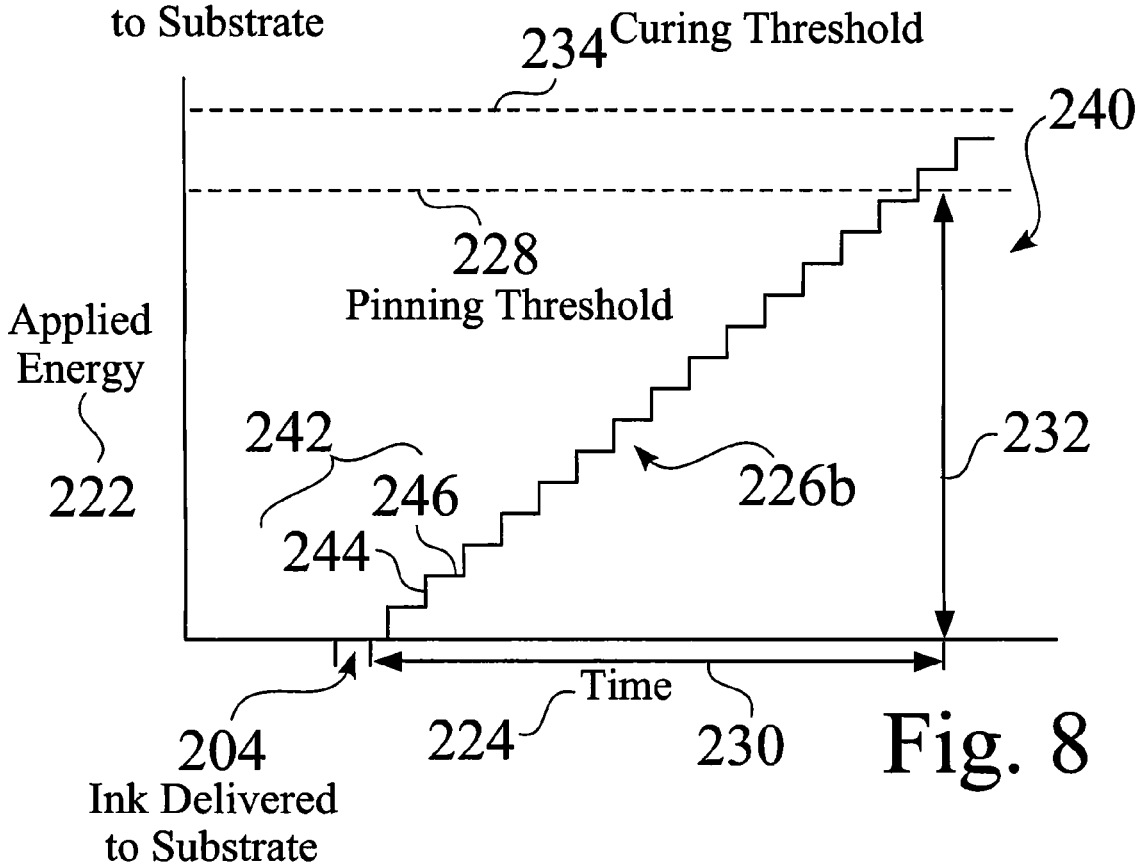
FIG. 8 is a chart that shows applied energy as a function of time for an enhanced printing system, wherein the pinning energy is increased in a series of steps.

FIG. 8 is a chart 240 that shows applied energy 222 as a function of time 224 for an enhanced printing system 60, wherein the pinning energy 226, e.g. 226*b*, is increased in a series of steps 242. For example, as seen in FIG. 8, after ink 82 is delivered 206, e.g. jetted 206, onto a substrate 12, pinning energy 226*b* is applied through one or more pinning lamps 44, such as to provide a stepped increase in energy 222 over a period 230 of time 224, e.g. until the applied energy 50 reaches or extends beyond a pinning threshold 228. As discussed above, while some system embodiments 60 may directly control the power output of one or more pinning lamps 44, other system embodiments 60 may further comprise one or more pinning shutters 46 and associated controls 88, which may be operated in conjunction with the pinning lamps 44 to controllably increase the delivered pinning energy 222 over a period 230 of time 224.

The steps 242 of applied energy 222 seen in FIG. 8 comprise a sequence of increases 244 in applied energy 50, which each have a characteristic duration 246. The stepped delivery 226*b* may be controlled in a variety of ways, such as but not limited to:

- approximating a constant linear increase in delivered energy 50, e.g. similar to 226*a;*
- providing a higher slope initially, followed by a decrease in delivered energy 50; or
- providing a lower slope initially, followed by an increase in delivered energy 50.

Figure 9:
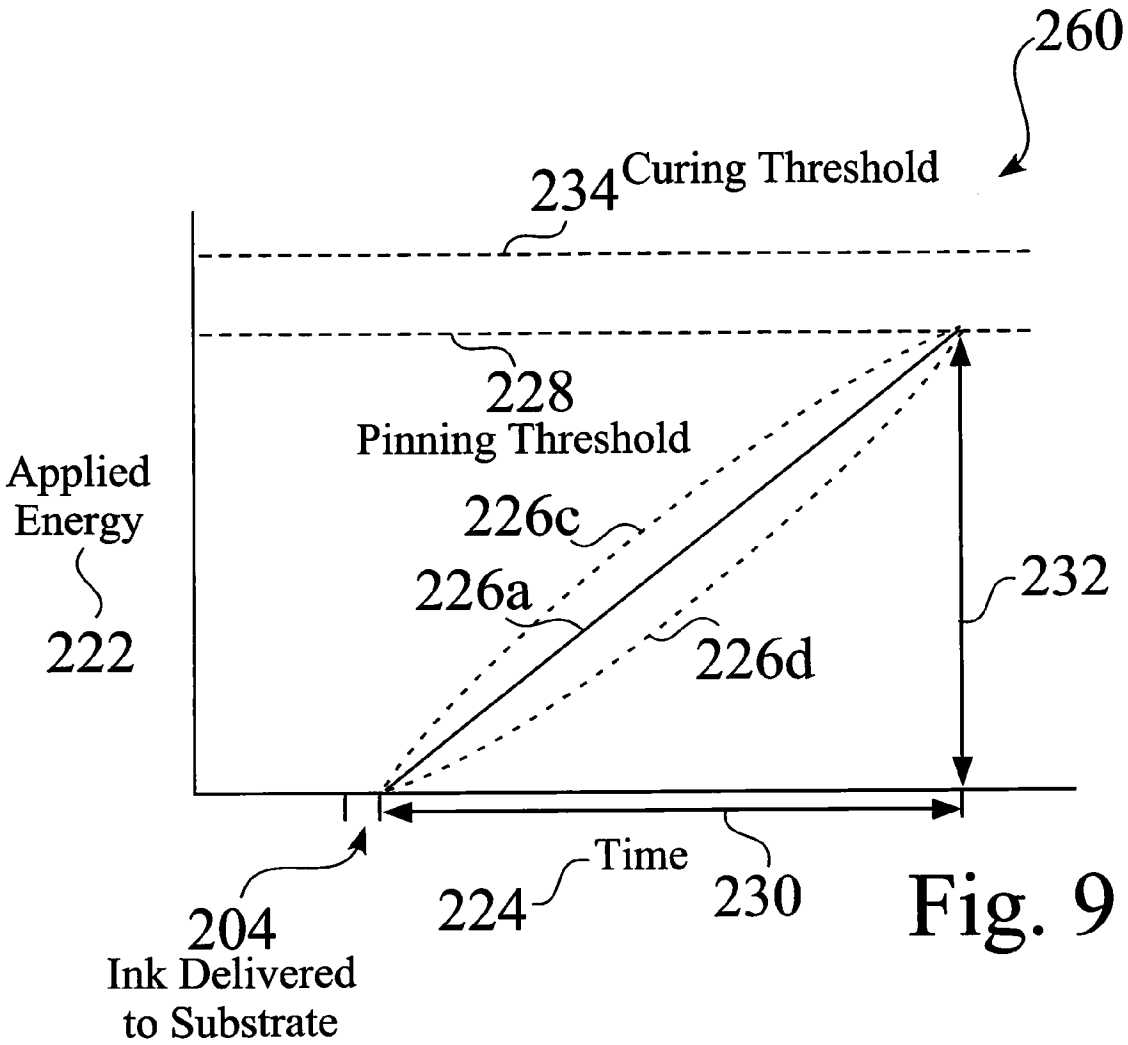
FIG. 9 is a chart that shows applied energy as a function of time for an enhanced printing system, wherein the pinning energy is linearly increased in any of a straight manner, a decreasing manner, or an increasing manner.

FIG. 9 is a chart 260 that shows applied pinning energy 222 as a function of time 224 for an enhanced printing system 60, wherein the pinning energy 226 is linearly increased in any of a constant manner 226*a*, a decreasing manner 226*c*, or an increasing manner 226*d*. For example, while pinning energy 222 may preferably be linearly increased 226, such as having a constant rate of increase, other methods of increasing the pinning energy 222 may provided. As seen in FIG. 9, delivered pinning energy 226*c* provides a higher slope initially, followed by a decrease in delivered energy 50. As also seen in FIG. 9, delivered pinning energy 226*d* provides a lower slope initially, followed by an increase in delivered energy 50. While the linear profiles 226*a*, 226*c*, 226*d* seen in FIG. 9 provide some examples of pinning energy delivery, it should be understood that other profiles may controllably be applied, as desired.

Figure 10:
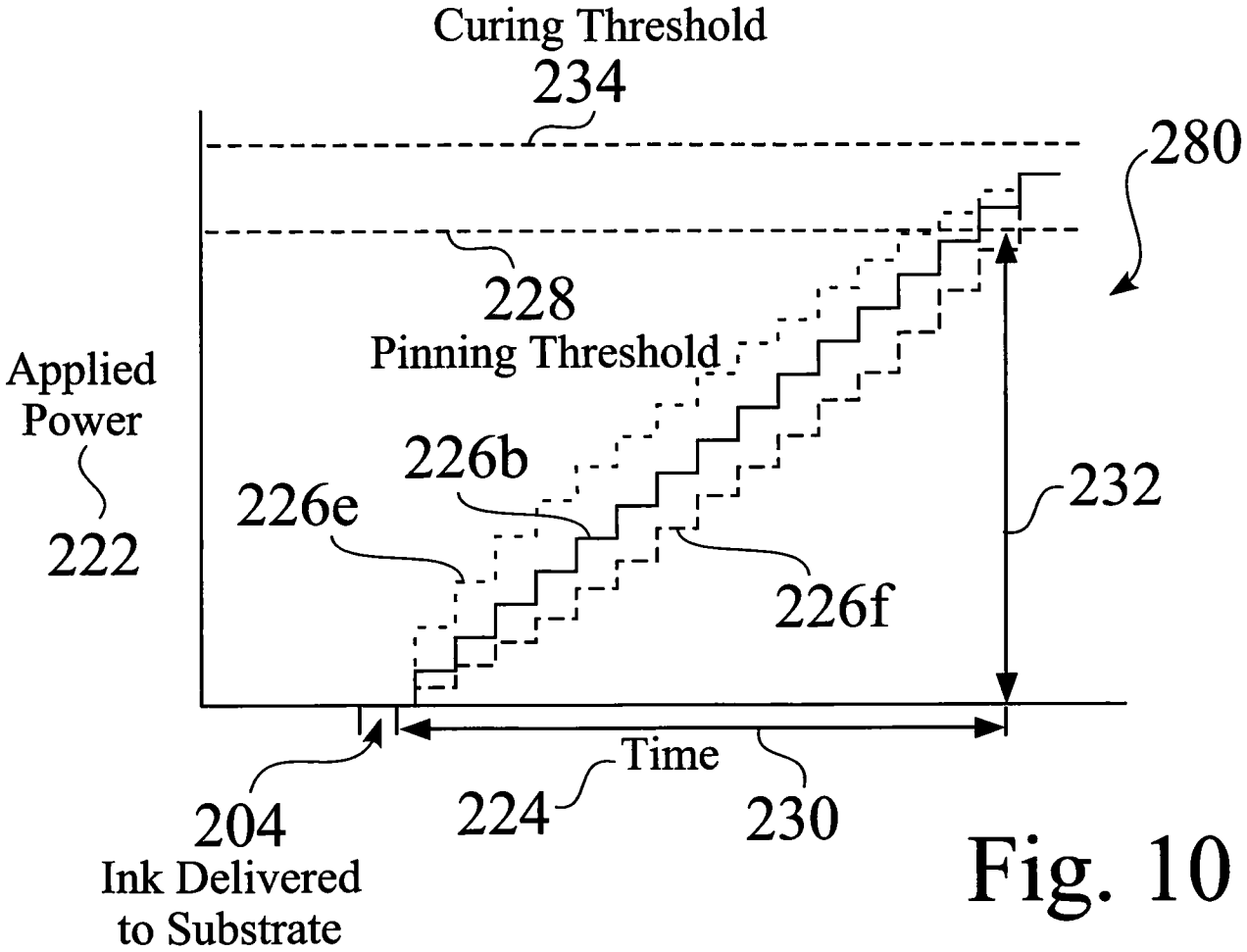
FIG. 10 is a chart that shows applied energy as a function of time for an enhanced printing system, wherein the pinning energy is increased in a series of steps, wherein the steps may preferably apply pinning energy in any of a constant manner, a decreasing manner, or an increasing manner.

FIG. 10 is a chart 280 that shows applied pinning energy 222 as a function of time 224 for an enhanced printing system 60, wherein the pinning energy 222 is increased in a series of steps 242, wherein the steps may preferably apply pinning energy in any of a constant manner 226*b*, a decreasing manner 226*e*, or an increasing manner 226*f*.

For example, while pinning energy 222 may preferably be increased 226*b* in a sequence of steps 242 having a generally constant rate of increase, other methods of increasing the pinning energy 222 may be provided. As seen in FIG. 10, delivered pinning energy 226*e* provides higher stepwise increments 244 initially, followed by a decrease in delivered energy 50. As also seen in FIG. 10, delivered pinning energy 226*f* provides a lower stepwise increments initially, followed by an increase in delivered energy 50. While the delivered step profiles 226*b*, 226*e*, 226*f* seen in FIG. 10 provide some examples of stepped pinning energy delivery, it should be understood that other profiles may controllably be applied, as desired. For example, any of the energy rise 244 or the step duration 246 between steps 242 may preferably be controlled, for one or more of the steps 242, as desired, such as to reduce or eliminate printing artifacts, and/or to reduce the time required to pin and/or cure the applied ink 82.

Figure 12:
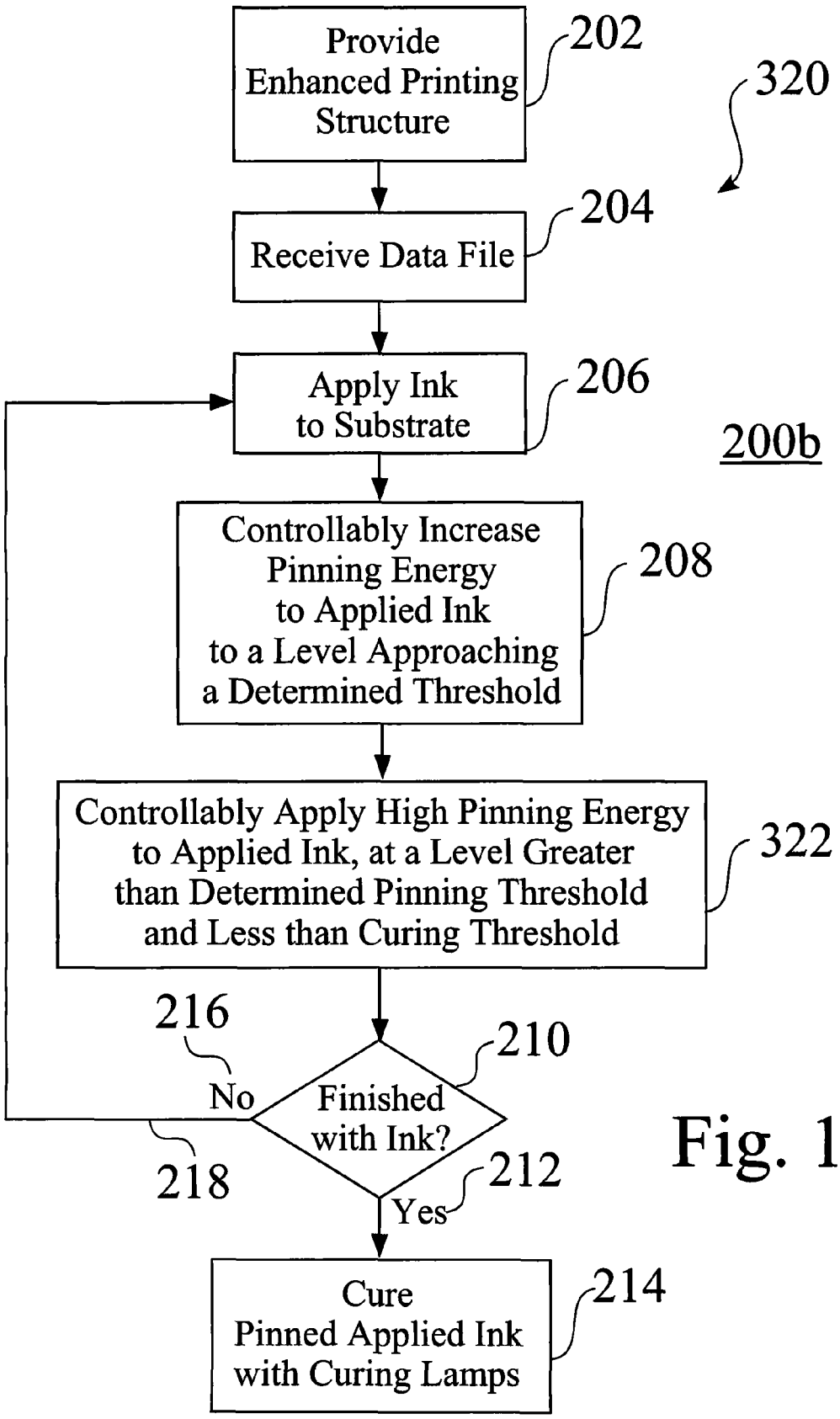
FIG. 12 is a flowchart of an exemplary process associated with an alternate enhanced printing system, wherein high pinning may preferably be applied to pinned ink on a substrate before final curing.

FIG. 11 is an exemplary block diagram 300 of an alternate enhanced printing system 60, e.g. 60*b*, that may be configured to provide high pinning 322 (FIG. 12). The exemplary printing system seen in FIG. 11 typically comprises one or more pinning lamps 44, e.g. 44*a*, one or more pinning shutters 46, one or more high pinning lamps 44*b*, and one or more processors 66. The exemplary base module 62 seen in FIG. 11 typically comprises a controller 64 having one or more processors 66 associated therewith, and at least one storage 68, such as for storing any of energy delivery parameters, data files, setpoints, or thresholds.

The base module 62 and controller 64 seen in FIG. 11 may preferably provide control for one or more associated systems, such as but not limited to any of:

- a substrate movement mechanism 72 and associated hardware 74, e.g. rollers, platen, input and/or output, etc.;
- a carriage movement mechanism 76 associated with a printer carriage 78;
- an ink delivery system 80 for delivering ink 82 to one or more print heads 84;
- a pinning lamp power mechanism 86 associated with one or more pinning lamps 44;
- a high pinning lamp power mechanism 84*b* associated with one or more high pinning lamps 44*b;*
- a pinning shutter control mechanism 88 associated with one or more pinning shutters 46; and/or
- a curing lamp power mechanism 94 associated with one or more curing lamps 96.

FIG. 12 is a flowchart 320 of an exemplary process 200*b* associated with an alternate enhanced printing system 60, e.g. 60*b*, wherein high pinning 322 may preferably be applied to pinned ink 82 on a substrate 12, before final curing 214. For example, through a provided 202 enhanced printing system 60, e.g. 60*b*, in response to a received 204 data file, ink 82 is controllably applied 206, e.g. jetted 206, onto one or more portions of a substrate 12. At step 208, such as though the controller 64, pinning energy 50 is controllably increased to the applied ink 82, such as to a level at or approaching a determined pinning threshold 228. At step 322, such as though the controller 64, high pinning energy, e.g. at a level greater than a low pinning threshold 228 and lower than a curing threshold 234, is controllably applied to the low pinned ink 82. High pinning 322 may preferably be applied in a manner similar to the low pinning 226, e.g. such is in an increasing linear or stepped manner. If more ink passes are required 210, 216, the process 200*b* may return 218, e.g. such as to add another ink color, e.g. a process color cyan C, magenta M, yellow Y, Black K, or a spot color, to build an image 14. If no further ink passes are required 210, 212, the process 200*b* typically proceeds to step 214, wherein the pinned applied ink 82 is cured, through applied curing energy delivered from one or more curing lamps 96.

The structure and process of applying high pinning energy 322, which may otherwise be referred to as low curing, is typically performed after printing 206 and low pinning 208, but before final curing 214, and may preferably be controlled to avoid a sudden increase in applied energy at a cure lamp 96, which may otherwise degrade the final quality of the printed substrate. High pinning 322 may therefore preferably be used to avoid artifacts that may otherwise occur in printed matter.

One or more areas of the enhanced printing system 60, e.g. 60*a*, 60*b*, may be used for any of low pinning 208 and/or high pinning 322. For example, in some system embodiments, pinning lamps 44, e.g. low pinning lamps 44*a* and/or high pinning lamps 44*b* may be located within the print area, e.g. at or near where ink 82 is jetted 206 onto the substrate 12, while curing lamps 96 may preferably be located in an area adjacent to the print area, wherein a substrate 12, or a printed and pinned portion of a substrate 12, may preferably be transferred or otherwise moved before curing 214.

In some embodiments of the enhanced printing system 60, low pinning lamps 44*a* may preferably be located within the print area, e.g. at or near where ink 82 is jetted 206 onto the substrate 12, while one or more high pinning lamps 44*b* may preferably be located in an intermediate region, e.g. after the print area, but before a curing area.

Figure 13:
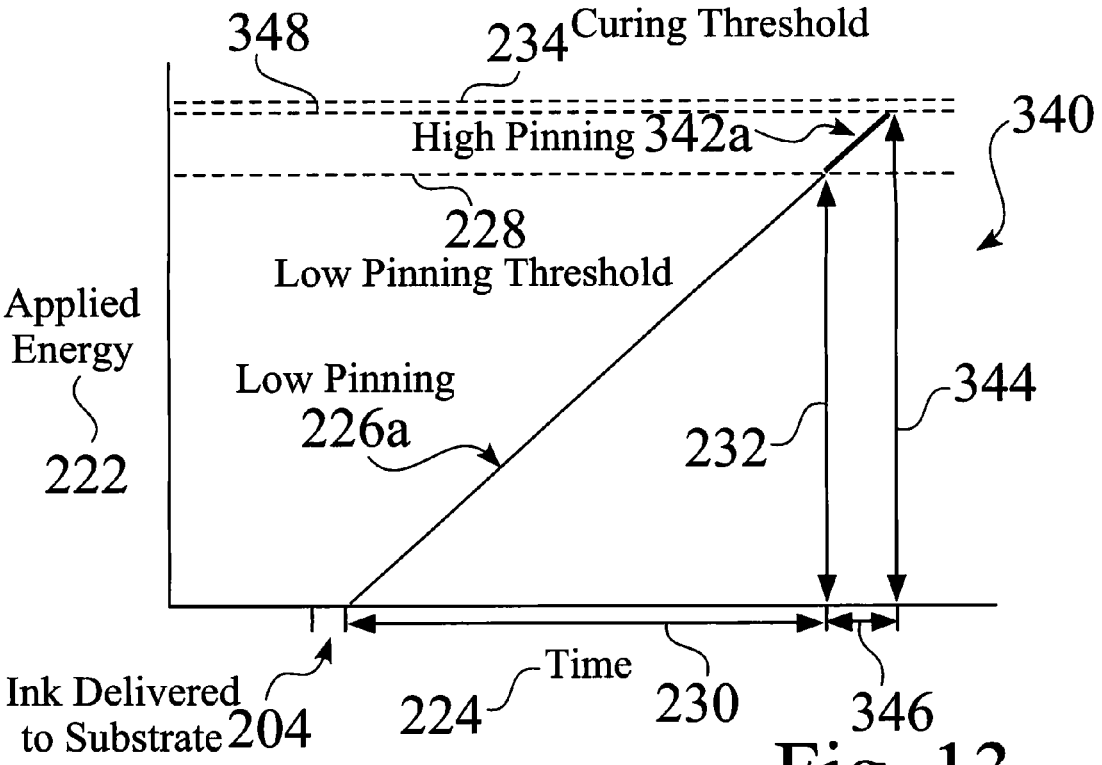
FIG. 13 is a chart that shows applied pinning energy as a function of time for an enhanced printing system, wherein the pinning energy is linearly increased, and wherein high pinning may be applied after low pinning and before curing.

FIG. 13 is a chart 340 that shows applied pinning energy 222 as a function of time 224 for an enhanced printing system 60*b*, wherein the pinning energy 226, e.g. 226*a*, is linearly increased, and wherein high pinning 342*a* is applied after low pinning 226*a*, but before curing 214. For example, as seen in FIG. 13, after ink 82 is delivered 206, e.g. jetted 206, onto a substrate 12, low pinning energy 226*a* is applied through one or more low pinning lamps 44*a*, such as to provide a linear increase in energy 222 over a period 230 of time 224, e.g. until the applied energy 226 reaches or extends beyond a low pinning threshold 228. While some system embodiments 60 may directly control the power output of one or more low pinning lamps 44*a*, other system embodiments 60 may further comprise one or more pinning shutters 46 and associated controls 88, which may be operated in conjunction with the pinning lamps 44*a*, to controllably increase the delivered pinning energy 50 over a period 230 of time 224.

After low pinning 226, e.g. 226*a*, high pinning energy 342, e.g. 342*a*, is applied 322 through one or more high pinning lamps 44*b*, such as to provide a linear increase in energy 222 over a second period 346 of time 224, e.g. until the applied energy 342 reaches or extends beyond a high pinning threshold 348. While some system embodiments 60 may directly control the power output of one or more high pinning lamps 44*b*, other system embodiments 60 may further comprise one or more pinning shutters 46 and associated controls 88, which may be operated in conjunction with the high pinning lamps 44*b*, to controllably increase the delivered pinning energy 342 over a period 346 of time 224.

Figure 14:
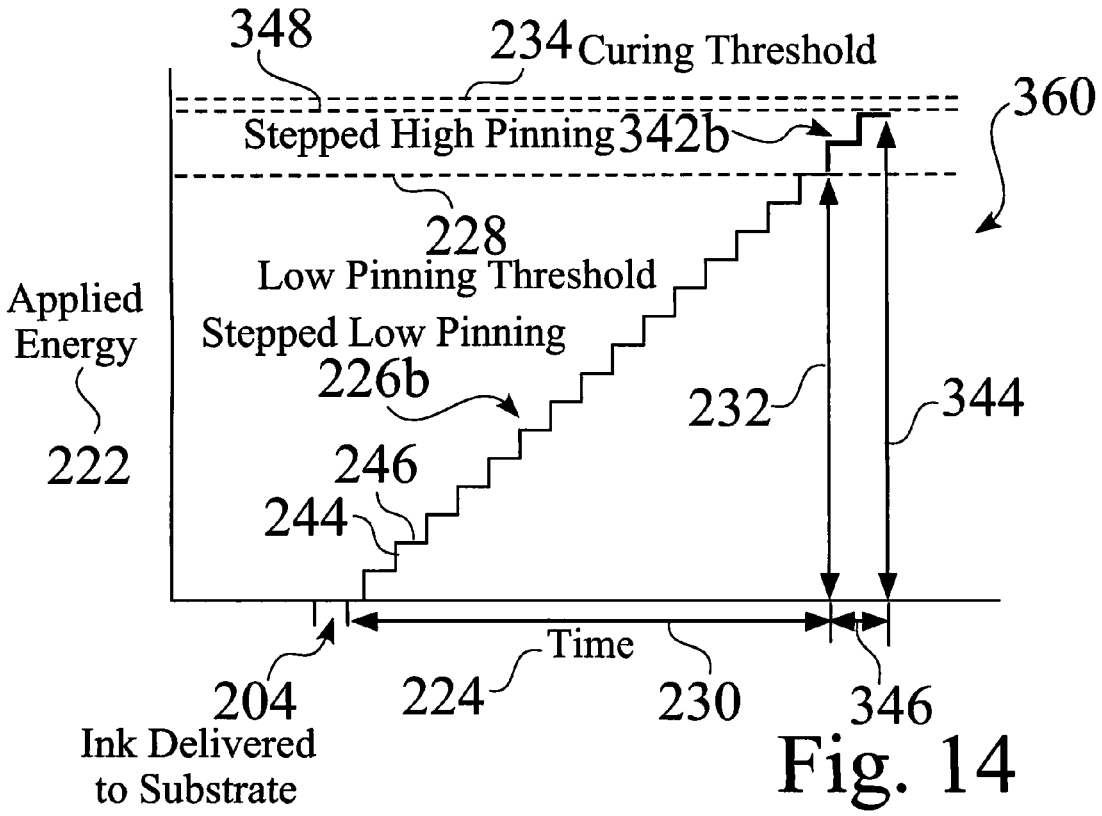
FIG. 14 is a chart that shows applied energy as a function of time for an enhanced printing system, wherein the pinning energy is increased in a series of steps, and wherein high pinning may be applied after low pinning and before curing.

FIG. 14 is a chart 360 that shows applied low pinning energy 222 as a function of time for an enhanced printing system 60*b*, wherein the low pinning energy 226, e.g. 226*a*, is increased in a series of steps 242, and wherein high pinning 342*b* is applied after low pinning 226*b*, but before curing 214. For example, as seen in FIG. 14, after ink 82 is delivered 206, e.g. jetted 206, onto a substrate 12, pinning energy 226*b* is applied through one or more low pinning lamps 44*a*, such as to provide a stepped increase in energy 232 over a period 230 of time 224, e.g. until the applied energy 232 reaches or extends beyond a low pinning threshold 228. While some system embodiments 60*b* may directly control the power output of one or more low pinning lamps 44*a*, other system embodiments 60*b* may further comprise one or more pinning shutters 46 and associated controls 88, which may be operated in conjunction with the low pinning lamps 44*a* to controllably increase the delivered pinning energy 50 over a period 230 of time 224.

After low pinning 226, e.g. 226*b*, high pinning energy 342, e.g. 342*b*, is applied 322 through one or more high pinning lamps 44*b*, such as to provide a stepped increase in energy 344 over a second period 346 of time 224, e.g. until the applied energy 342*b* reaches or extends beyond a high pinning threshold 348. While some system embodiments 60 may directly control the power output of one or more high pinning lamps 44*b*, other system embodiments 60 may further comprise one or more pinning shutters 46 and associated controls 88, which may be operated in conjunction with the high pinning lamps 44*b*, to controllably increase the delivered pinning energy 342 over a period 346 of time 224.

The steps of applied high pinning energy 342 seen in FIG. 14 may also comprise a sequence of increases 244 in applied energy 222, which each have a characteristic duration 246. The stepped delivery 342*b* may be controlled in a variety of ways, such as but not limited to:

- approximating a constant or linear increase, e.g. similar to 342*a;*
- providing a higher slope initially, followed by a decrease in delivered energy 50; or
- providing a lower slope initially, followed by an increase in delivered energy 50.

Figure 15:
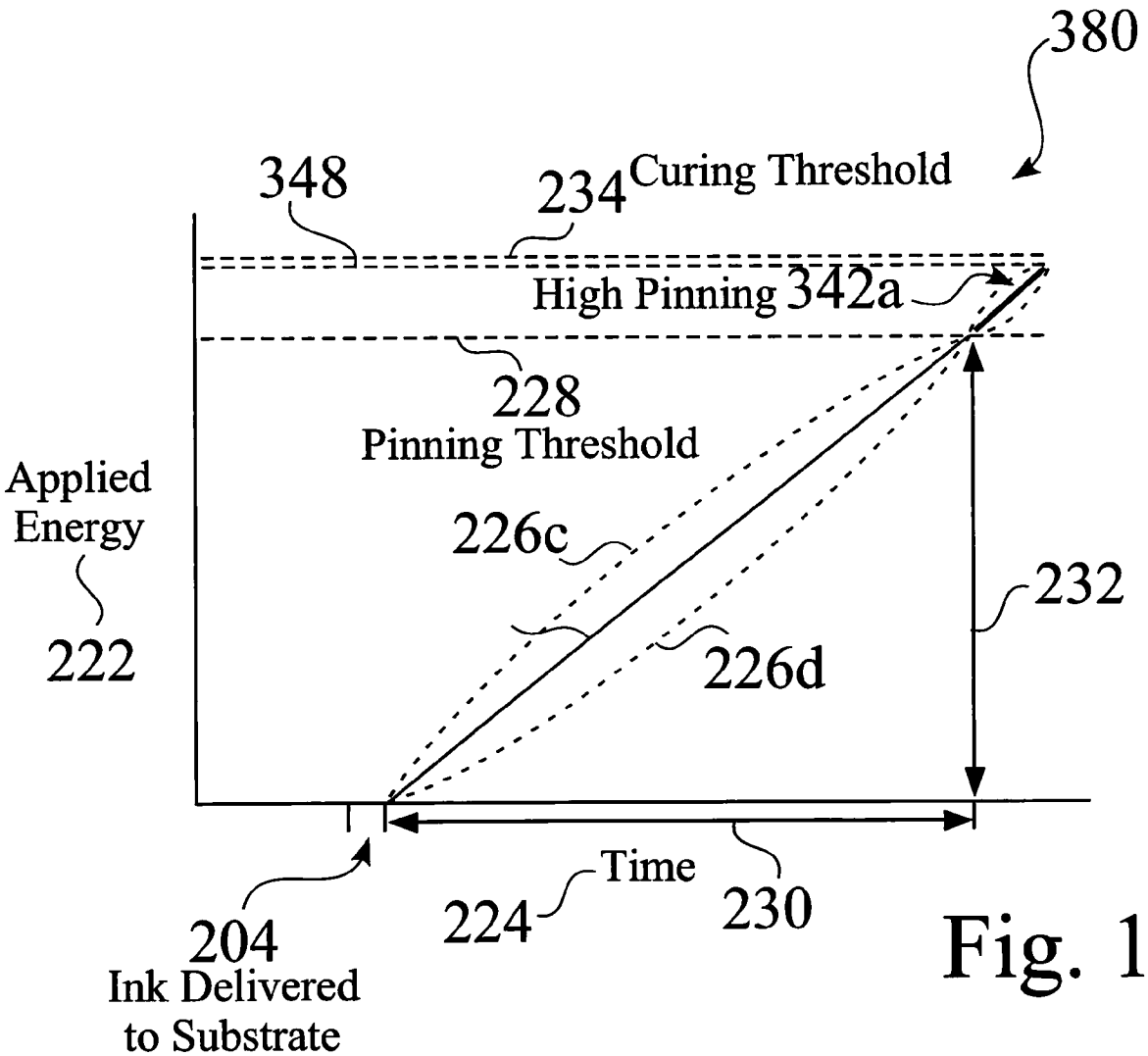
FIG. 15 is a chart that shows applied energy as a function of time for an enhanced printing system, wherein the pinning energy is linearly increased in any of a constant manner, a decreasing manner, or an increasing manner, and wherein high pinning may be applied after low pinning and before curing.

FIG. 15 is a chart 380 that shows applied pinning energy 222 as a function of time 224 for an enhanced printing system 60*b*, wherein low pinning energy 226 is linearly increased in any of a straight manner 226*a*, a decreasing manner 226*a*, or an increasing manner 226*d*, and wherein high pinning 342*a* is applied after low pinning 226, but before curing 214. For example, as seen in FIG. 15, after ink 82 is delivered 206, e.g. jetted 206, onto a substrate 12, low pinning energy 226 is applied through one or more low pinning lamps 44*a*, such as to provide a linear increase in energy 222 over a period 230 of time 224, e.g. until the applied energy 226 reaches or extends beyond a low pinning threshold 228. While some system embodiments 60 may directly control the power output of one or more low pinning lamps 44*a*, other system embodiments 60 may further comprise one or more pinning shutters 46 and associated controls 88, which may be operated in conjunction with the pinning lamps 44*a*, to controllably increase the delivered low pinning energy 226 over a period 230 of time 224.

After low pinning 226, e.g. 226*a*, 226*c*, 226*d*, high pinning energy 342, e.g. 342*a*, is applied 322 through one or more high pinning lamps 44*b*, such as to provide a linear increase in energy 222, e.g. any of a straight manner, a decreasing manner, or an increasing manner, over a second period 346 of time 224, e.g. until the applied energy 342, e.g. 342*a*, reaches or extends beyond a high pinning threshold 348. While some system embodiments 60 may directly control the power output of one or more high pinning lamps 44*b*, other system embodiments 60 may further comprise one or more pinning shutters 46 and associated controls 88, which may be operated in conjunction with the high pinning lamps 44*b*, to controllably increase the delivered high pinning energy 342 over a period 346 of time 224.

Figure 16:
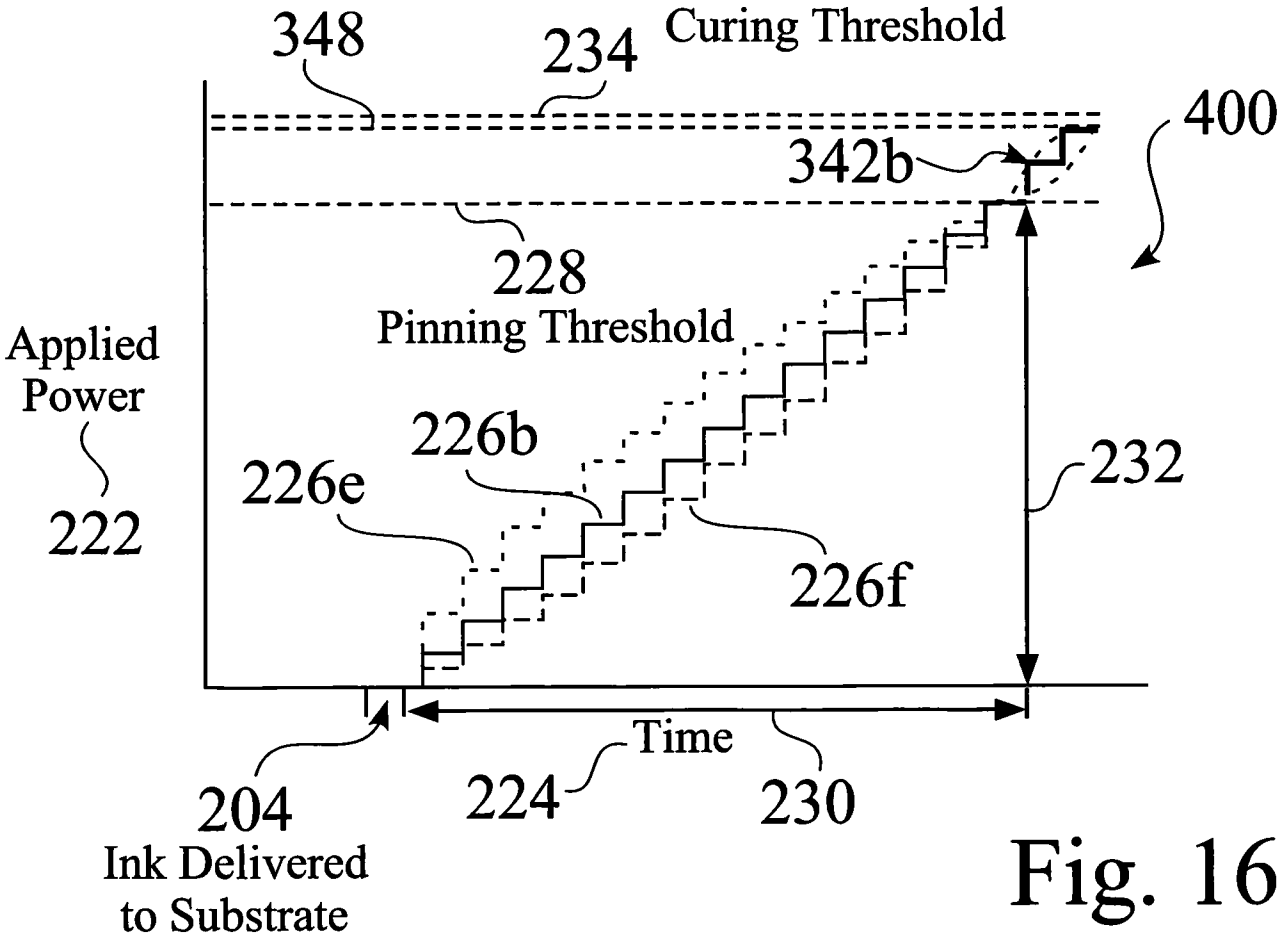
FIG. 16 is a chart that shows applied energy as a function of time for an enhanced printing system, wherein the pinning energy is increased in a series of steps, wherein the steps may preferably apply pinning energy in any of an increasing or decreasing manner, and wherein high pinning may be applied after low pinning and before curing.

FIG. 16 is a chart 400 that shows applied pinning energy 222 as a function of time 224 for an enhanced printing system 60*b*, wherein low pinning energy 226 is increased in a series of steps 242, wherein the steps 242 may preferably apply low pinning energy 226 in any of a generally linear manner, a generally increasing manner, or a generally decreasing manner, and wherein high pinning 342*b* is applied after low pinning 226, but before curing 214.

Figure 22:
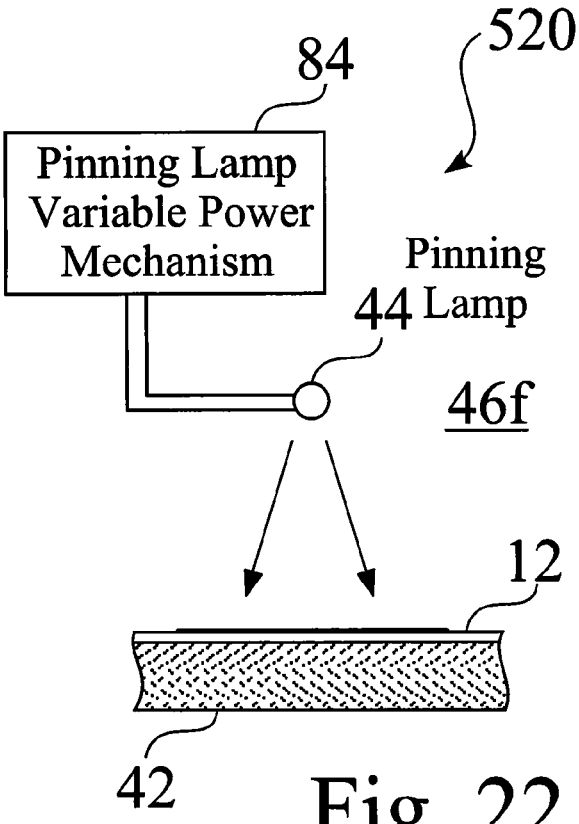
FIG. 22 is a schematic view of variably controlling power to one or more pinning lamps.

For example, as seen in FIG. 16, after ink 82 is delivered 206, e.g. jetted 206, onto a substrate 12, low pinning energy 226 is applied through one or more low pinning lamps 44*a*, such as to provide a stepped increase in energy 222 over a period 230 of time 224, e.g. until the applied energy 232 reaches or extends beyond a low pinning threshold 228. While some system embodiments 60 may directly control 84 the power output of one or more low pinning lamps 44*a*, such as seen in FIG. 22, other system embodiments 60 may further comprise one or more pinning shutters 46 and associated controls 88, which may be operated in conjunction with the pinning lamps 44*a*, to controllably increase the delivered low pinning energy 226 over a period 230 of time 224.

After low pinning 226, e.g. 226*b*, 226*e*, 226*f*, high pinning energy 342, e.g. 342*b*, is applied 322 through one or more high pinning lamps 44*b*, such as to provide a linear or stepped increase in energy 222, e.g. in any of a straight manner, a decreasing manner, or an increasing manner, over a second period 346 of time 224, e.g. until the applied energy 342, e.g. 342*a*, reaches or extends beyond a high pinning threshold 348. While some system embodiments 60 may directly control the power output of one or more high pinning lamps 44*b*, such as seen in FIG. 22, other system embodiments 60 may further comprise one or more pinning shutters 46 and associated controls 88, which may be operated in conjunction with the high pinning lamps 44*b*, to controllably increase the delivered high pinning energy 342 over a period 346 of time 224.

A wide variety of mechanisms 46 may preferably be implemented within the enhanced printing system 60 to alter the delivered energy of one or more pinning lamps 48 to at least one portion of a substrate 12.

Figure 17:
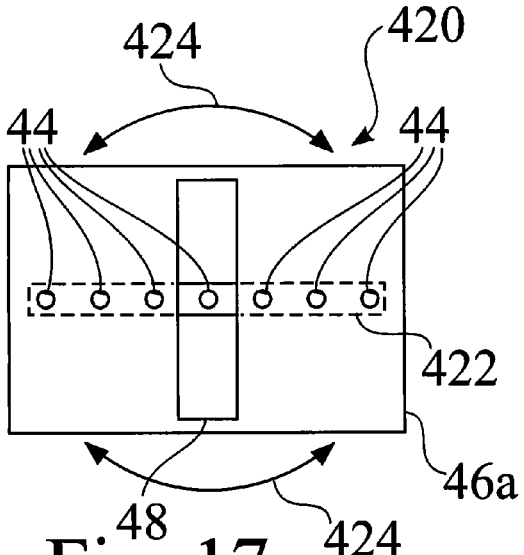
FIG. 17 is a schematic view of an exemplary pinning shutter that operates through rotation.

For example, FIG. 17 is a schematic view 420 of an exemplary pinning shutter 46*a* that operates through rotation 424, wherein ultraviolet light 50 is controllably varied based on a rotational position of one or more apertures 48. As seen in FIG. 17, a plurality of pinning lamps 44 may be mounted within an array 422, wherein the rotational position 424 of the aperture 48 with respect to the array 422 is controllable to increase or decrease delivered pinning energy 50, by varying the alignment and shading of the light based on the rotational position of the aperture 48.

Figure 18:
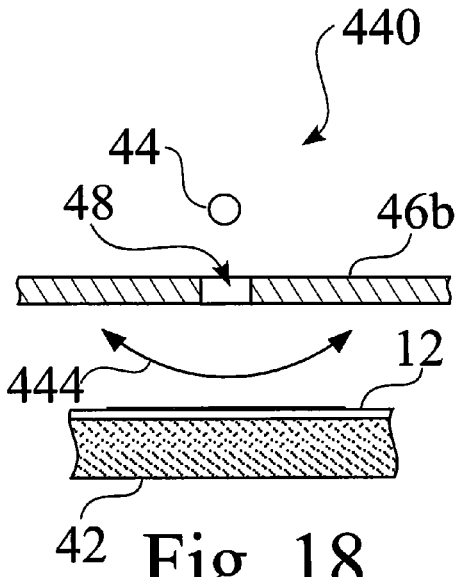
FIG. 18 is a schematic view of an exemplary pinning shutter that operates through pivoting.

FIG. 18 is a schematic view 440 of an exemplary pinning shutter 46*b* that operates through pivoting 444, wherein a tilt position 444 of the aperture 48 with respect to one or more lamp 44 is controllable to increase or decrease delivered pinning energy 50.

Figure 19:
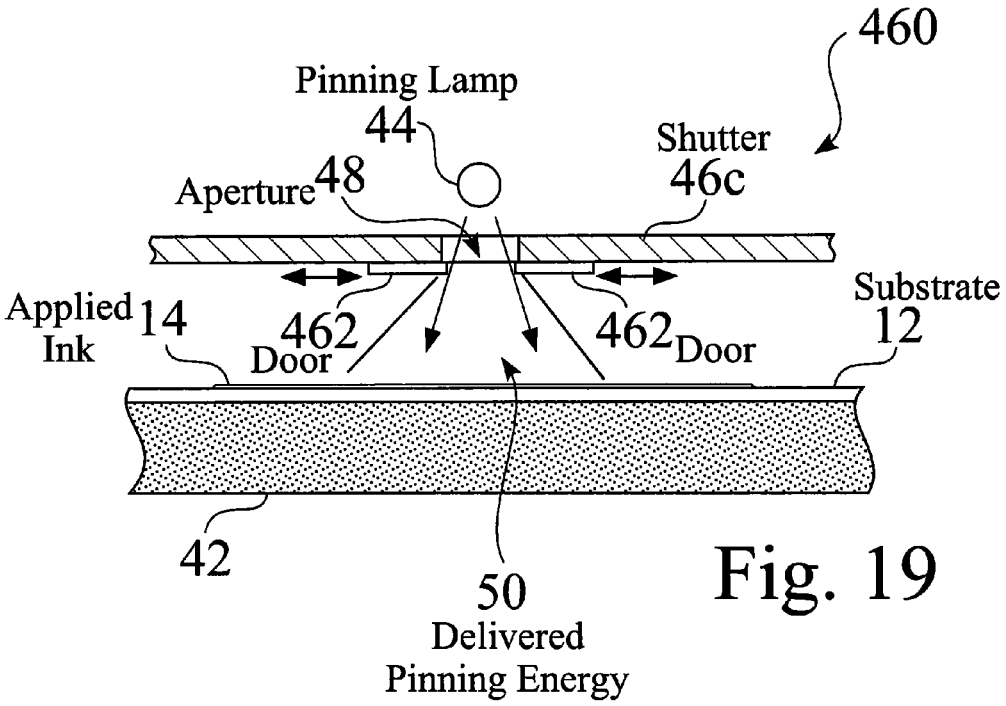
FIG. 19 is a schematic view of an exemplary pinning shutter that operates through one or more sliding doors.

FIG. 19 is a schematic view 460 of an exemplary pinning shutter 46*c* that operates through one or more sliding doors 462, wherein the position of the doors 462 with respect to an aperture 48 and to one or more pinning lamps 44 is controllable to increase or decrease delivered pinning energy 50.

Figure 20:
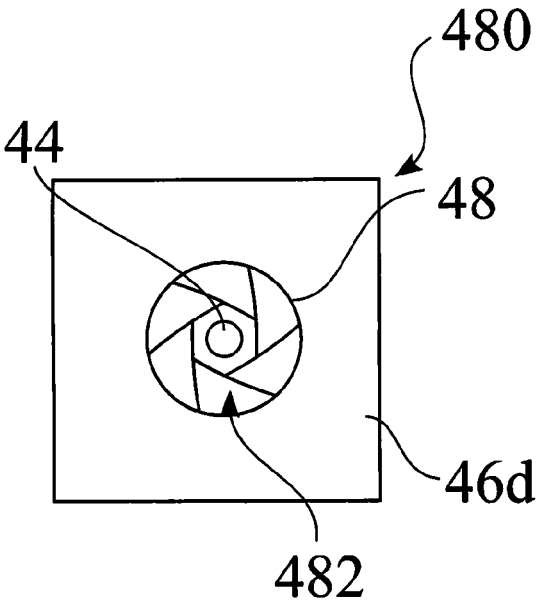
FIG. 20 is a schematic view of an exemplary pinning shutter that operates through a polygonal shutter.

FIG. 20 is a schematic view 480 of an exemplary pinning shutter 46*d* that operates through a polygonal shutter 482, wherein the position of the polygonal shutter 482 with respect to one or more pinning lamps 44 is controllable to increase or decrease delivered pinning energy 50.

Figure 21:
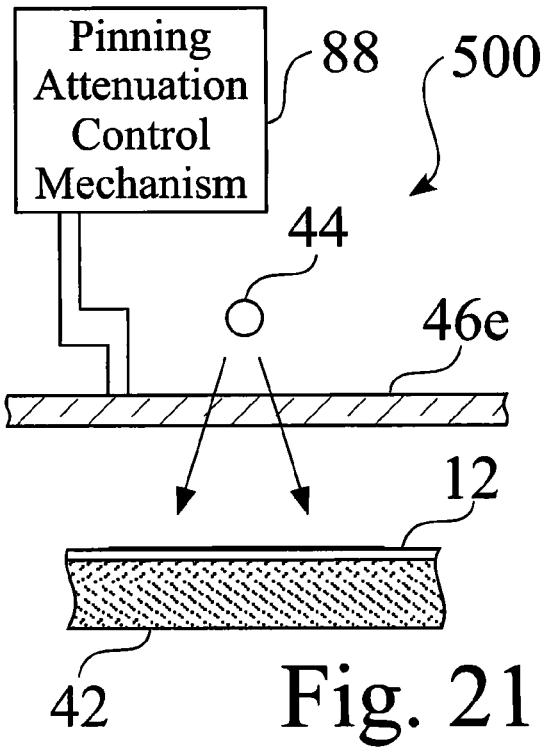
FIG. 21 is a schematic view of an exemplary pinning shutter that operates through one or more panels having controllable emissivity.

FIG. 21 is a schematic view 500 of an exemplary pinning shutter 46*e* that comprises electrically switchable panels, e.g. one or more powered glass or polycarbonate panels 46*e* that change light transmission properties when voltage is applied. For example, an exemplary powered shutter 46*e* may comprises Screen Solutions Electric Glass, available through Screen Solutions, International, Roseville, Calif. The pinning shutter 46*e* is controllable 88 to increase or decrease delivered pinning energy 50, based on the controlled light transmission properties.

Figure 23:
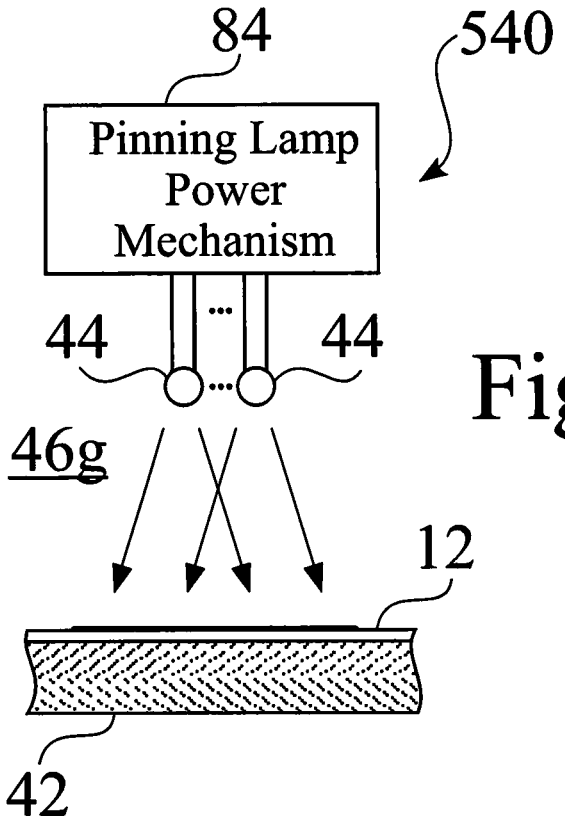
FIG. 23 is a schematic view of a mechanism for altering the delivered energy to at least one portion of the substrate, wherein power may be applied to one or more pinning lamps.

FIG. 22 is a schematic view 520 of an exemplary pinning shutter 46*f* that operates through the control of power to one or more pinning lamps 44, such as to increase or decrease delivered pinning energy 50 through a pinning lamp variable power mechanism 84. FIG. 23 is a schematic view 540 of a mechanism 46*g* for altering the delivered energy to at least one portion of a substrate 12, wherein power may be applied to one or more pinning lamps 44.

Figure 24:
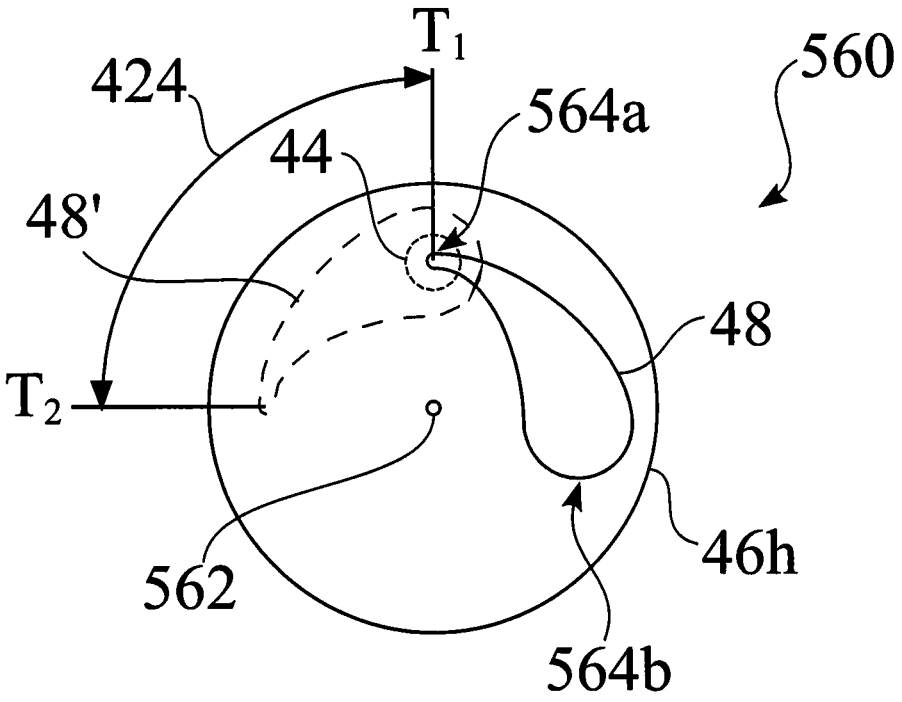
FIG. 24 is a schematic view of an alternate exemplary pinning shutter that operates through rotation.

FIG. 24 is a schematic view 560 of an alternate exemplary pinning shutter 46*h* that operates through rotation 424, wherein ultraviolet light 50 is controllably varied based on a rotational position of one or more apertures 48. As seen in FIG. 24, one or more pinning lamps 44 may be mounted in a fixed position with respect to the rotational axis 562 of the shutter 46*h*. The rotational position 424 of the aperture 48 with respect to the pinning lamps 44 is controllable to increase or decrease delivered pinning energy 50, by varying the alignment and shading of the light based on the rotational position of the aperture 48. For example, at a time $T_1$, a first end 564 of the aperture 48 is generally aligned with the pinning lamps 44, thus providing a small level of pinning energy 50. The shutter 46*h* is controllably rotatable 424 to advance toward a second position at time $T_2$, wherein a second end 564*b* of the rotated aperture 48' is generally aligned with the pinning lamps 44, thus providing a high level of pinning energy 50.

Figure 25:
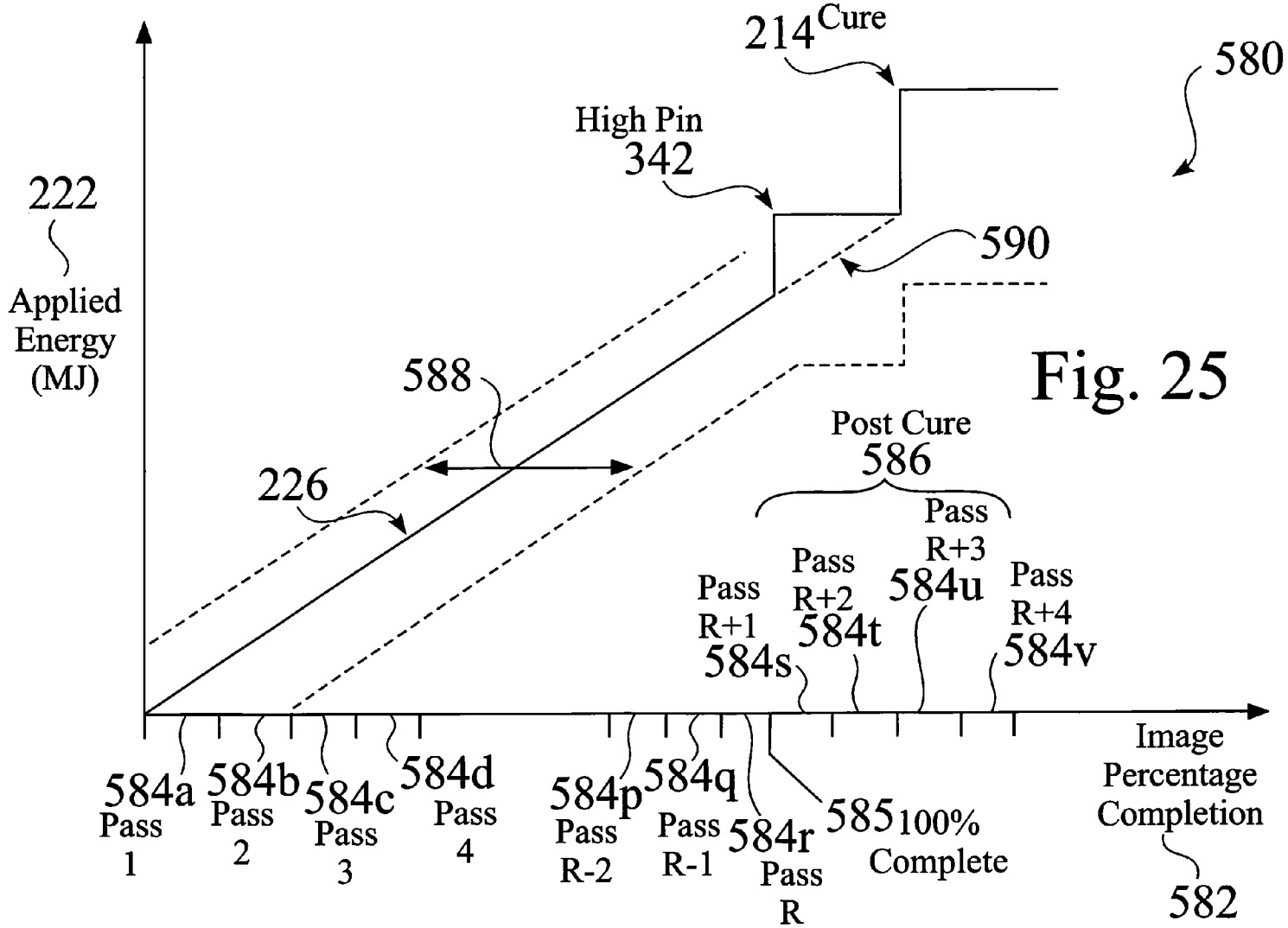
FIG. 25 is a chart that shows applied energy as a function of image percentage completion for an enhanced printing system, wherein low pinning energy is linearly increased, and wherein high pinning may preferably be applied after the low pinning and before curing.

FIG. 25 is a chart 580 that shows applied energy as a function of image percentage completion 582 for an enhanced printing system 60, e.g. 60*a* or 60*b*, wherein low pinning energy 226 is linearly increased in any of a constant manner, a decreasing manner, or an increasing manner, and wherein high pinning 342 may preferably be applied after the low pinning 226 and before curing 214. The enhanced printing system 60 often comprises a plurality of print heads 84, such as to deliver plurality of inks 82, e.g. 82*a*-82*k*, to establish an image 14 on a substrate 12, through one or more passes 584, e.g. 584*a*-584*r*.

As seen in FIG. 25, low pinning energy 226 may preferably be applied 208 to inks 82 that have previously been jetted 206 onto the substrate 12, while other ink 82 is delivered 206. For example, successive layers of ink 82 may preferably be pinned 208 before a next layer is jetted 206.

Upon full completion 585, e.g. 100 percent completion 585, of an image 14, such as within a print area 604 (FIG. 26) of the enhanced printing system 60, post curing steps 586 are performed, such as during subsequent passes 584, e.g. 584*s*-584*v*, of the printer carriage 78. For example, in some embodiments of the enhanced printing system 60, the substrate 14 is stepped from a print area 604 to a post print area 606 upon image completion 585. As well, some embodiments of the printer carriage 78 may house one or more cure lamps 96, and may also comprise one or more high pinning lamps 48*b*, such that any of high pinning 322 or curing 214 may be performed as the carriage 78 passes over the pinned substrate 14.

As also seen in FIG. 25, the applied energy 222, such as for low pinning, may be varied 588, such as based on the number of passes 584 required to establish an image 14. As also indicated 590, some embodiments of the enhanced printing system 60 may not include high pinning 342.

Figure 26:
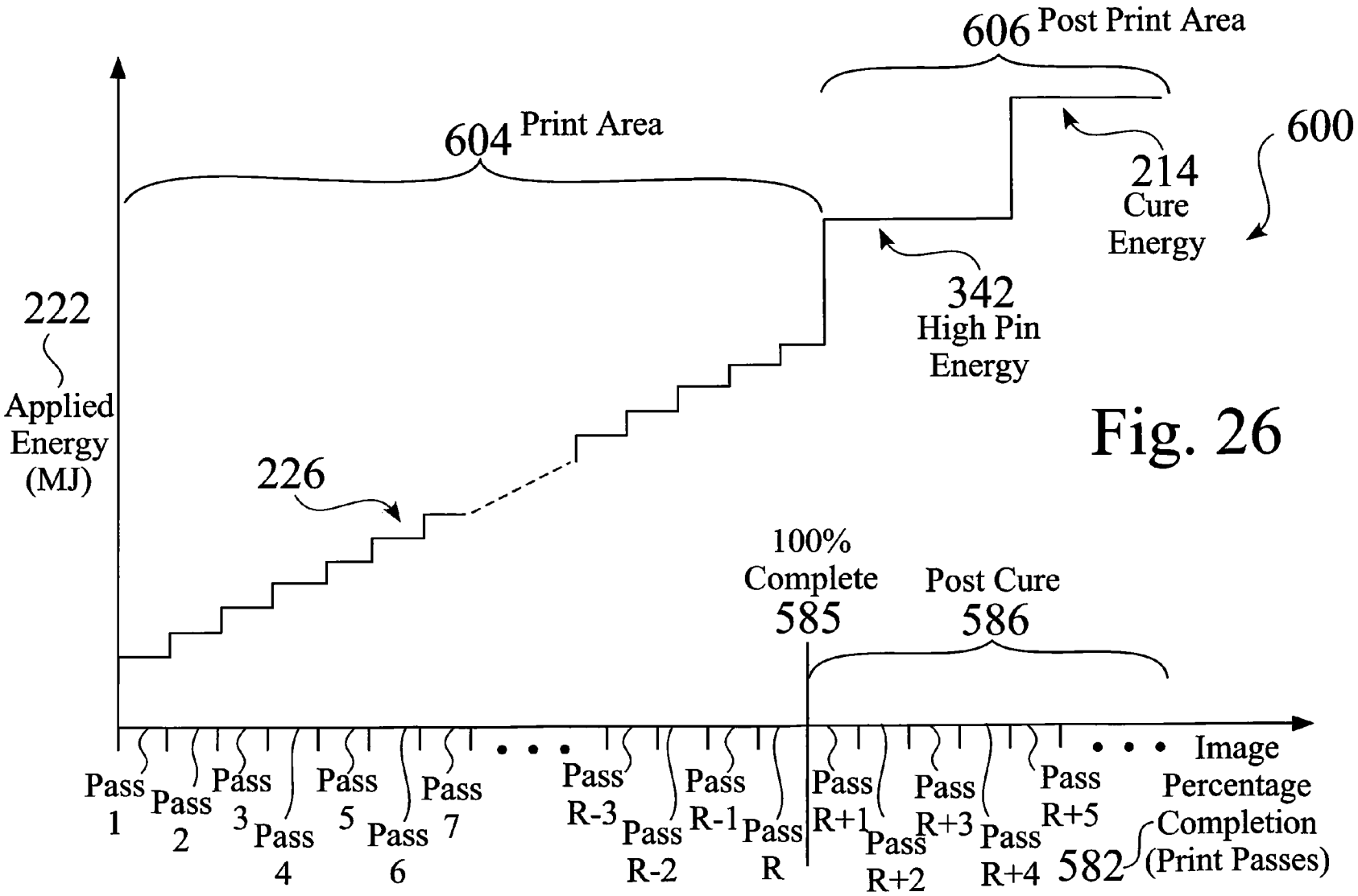
FIG. 26 is a chart that shows applied energy as a function of image percentage completion for an exemplary enhanced printing system, wherein low pinning energy is increased in a series of steps, and wherein high pinning may preferably be applied after the low pinning and before curing.

FIG. 26 is a chart 600 that shows applied energy as a function of image percentage completion 582 for an exemplary enhanced printing system 60, e.g. 60*a* or 60*b*, wherein low pinning energy 226 is increased in a series of steps, such as in any of a constant manner, a decreasing manner, or an increasing manner, and wherein high pinning 342 may preferably be applied after the low pinning 226 and before curing

214. The exemplary enhanced printing system 60 reflected in FIG. 26 comprises a plurality of print heads 84, such as to deliver plurality of inks 82, e.g. 82*a*-82*k*, to establish an image 14 on a substrate 12, through one or more passes 584, e.g. 584*a*-584*r*. As seen in FIG. 26, the relative completion of an image 14, which includes the steps of delivering 206, pinning 208, high pinning 322 as desired, and curing, may be considered to depend on a series of intervals, e.g. based upon print passes of a printer carriage 78.

The enhanced printing systems 60 and associated processes 200 are therefore highly configurable to provide improved pinning 208, 322 and curing 214 of inkjet printed ink 82, using one or more UV light sources 44. The enhanced printing systems 60 and associated processes 200 can control the delivered energy, from low power to high power, such as to avoid sharp transitions in cure energy from one area of the print to another. The ultra-violet (UV) inkjet printed ink 82 is polymerized, using different levels of UV dosages, from very low to very high, such as in a linear or stepped manner, before final curing 214.

The initial part of the curing process 200 is carried out using low energy UV irradiance, known as pinning 208. While the pinning 208 does not fully cure the ink 82, the pinning stops the delivered ink 82 from bleeding, such as between colors, and/or from high density to low density areas.

To avoid large changes in cure energy from one part of the print to another, the emission from the pinning lamps 44 is preferably increased gradually, such as to reach a pinning threshold 228, prior to being fully cured 214 by high power curing lamps 96.

The pinning energy threshold 228 that is preferably reached prior to curing 214 may preferably be determined by the print mode, e.g. print speed, as the faster an image is laid down, the higher the cure energy must be, to fully polymerize the inks 82. Therefore, the pinning threshold 228 from the pinning to the curing must also be higher, to avoid a large jump in cure energy, which may otherwise show up as a gloss differential in the final image 14.

The pinning energy 222 may preferably be controllably increased linearly, from zero to the exact level of the cure energy 234. This can be achieved by using a shutter 46, e.g. a mechanical shutter 46, that shrouds part of the pinning lamp 44, so as to create a continuously increasing exposure area.

The enhanced printing systems 60, processes 200, and associated structures can therefore be configured to remove any moderate or large transitions of UV light energy, by generating a linear increase in power or multi-stepped increase in power that has small transitions below the determined threshold that is known to cause image artifacts.

While some of the embodiments of pinning structures are described herein as comprising a shutter that is fixed or controllably movable or pivotable, it should be understood that the shutter structures and methods for their use may be implemented for systems that comprise a plurality of mechanical and or electronic shutters.

Accordingly, although the invention has been described in detail with reference to a particular preferred embodiment, persons possessing ordinary skill in the art to which this invention pertains will appreciate that various modifications and enhancements may be made without departing from the spirit and scope of the disclosed exemplary embodiments.

The invention claimed is:

1. A process for preventing artifacts in a printed image, comprising the steps of:

providing a printing system, wherein the printing system comprises at least one print head for applying light sensitive ink to a substrate, a mechanism for positioning any of the print head or the substrate in relation to each other, at least one pinning lamp, a mechanism for altering the delivered energy of the at least one pinning lamp to at least one portion of the substrate, at least one curing lamp, and at least one processor;

applying the light sensitive ink to the substrate with one or more of the print heads;

during a first pinning operation, providing pinning energy to the applied ink on the substrate with the at least one pinning lamp to low pin said applied ink, wherein the processor is configured to operate any of the at least one pinning lamp to controllably increase the pinning energy in an increasing linear or stepped manner over an interval to a low pinning threshold level;

during a second pinning operation, applying a second level pinning energy to the low pinned applied ink before a curing step, wherein the second level of pining energy is increased in a linear or stepped manner to a high pinning threshold level that is higher than the determined low pinning threshold level, and lower than a curing threshold level; and providing curing energy to the pinned applied ink on the substrate with the curing lamp, to cure the pinned applied ink.

2. The process of claim 1, wherein the at least one pinning lamp comprises at least one ultraviolet (UV) power source.

3. The process of claim 2, wherein the at least one ultraviolet (UV) power source comprises any of at least one mercury arc lamp, at least one ultraviolet (UV) light emitting diode (LED), or any combination thereof.

4. The process of claim 1, wherein the mechanism for altering the delivered energy of the at least one pinning lamp to at least one portion of the substrate comprises:

at least one shutter;

wherein the processor is configured to controllably operate the shutter to alter the delivered energy of the at least one pinning lamp.

5. The process of claim 1, wherein the determined threshold level is stored within a memory.

6. The process of claim 1, wherein the mechanism for altering the delivered energy of the at least one pinning lamp to at least one portion of the substrate comprises any of a mechanism for variably controlling the output power of one or more of the output lamps, or a shutter that is electrically controllable to adjust the delivered energy to the substrate from the pinning lamps.

7. The process of claim 1, wherein the interval comprises any of a period of time or a percentage of completion.

8. A system for preventing artifacts in a printed image, comprising:

at least one print head for applying light sensitive ink to a substrate;

a mechanism for positioning any of the print head or the substrate in relation to each other;

at least one pinning lamp;

a mechanism for altering the delivered energy of the at least one pinning lamp to at least one portion of the substrate;

at least one curing lamp, and at least one processor, wherein the at least one processor is configured to control one or more of the print heads to apply the light sensitive ink to the substrate, controllably increase an applied pinning energy through the at least one pinning lamp in an increasing linear or stepped manner over an interval to a determined threshold level to low pin said applied ink, and controllably operate the curing lamp to cure the pinned applied ink; and a mechanism applying a second level of pinning energy to the pinned applied ink before curing, wherein the second level of pinning energy is increased in a linear or stepped manner to a high pinning threshold level that is high than the determined low pinning threshold level, and lower than a curing threshold level.

9. The system of claim 8, wherein the at least one pinning lamp comprises at least one ultraviolet (UV) power source.

10. The system of claim 9, wherein the at least one ultraviolet (UV) power source comprises any of at least one mercury arc lamp, at least one ultraviolet (UV) light emitting diode (LED), or any combination thereof.

11. The system of claim 8, wherein the mechanism for altering the delivered energy of the at least one pinning lamp to at least one portion of the substrate comprises:

at least one shutter;

wherein the processor is configured to controllably operate the shutter to alter the delivered energy of the at least one pinning lamp.

12. The system of claim 8, further comprising:

a memory that is accessible by the at least one processor;

wherein the determined threshold level is stored within the memory.

13. The system of claim 8, wherein the interval comprises any of a period of time or a percentage of completion.

14. A structure for a printing system comprising a mechanism for delivering light curable ink onto a substrate that is supported by a platen, said structure provided for preventing artifacts in a printed image, wherein the structure comprises:

at least one pinning lamp for providing pinning energy to the substrate; and a mechanism for controllably altering the amount of pinning energy from the at least one pinning lamp in an increasing linear or stepped manner to low pin said applied ink; and a mechanism for controllably increasing an applied pinning energy through the at least one pinning lamp over an interval to a determined threshold level and for applying a second level of pinning energy to the pinned applied ink before curing, wherein the second level of pinning energy is increased in a linear or stepped manner to a high pinning threshold level that is higher than the determined low pinning threshold level, and lower than a curing threshold level.

15. The structure of claim 14, wherein the mechanism comprises at least one shutter between the at least one pinning lamp and the platen.

* * * * *